US007832462B2

(12) United States Patent
Basavanhally et al.

(10) Patent No.: US 7,832,462 B2
(45) Date of Patent: Nov. 16, 2010

(54) THERMAL ENERGY TRANSFER DEVICE

(75) Inventors: Nagesh R. Basavanhally, Skillman, NJ (US); Marc Scott Hodes, Dublin (IE); Paul Robert Kolodner, Hoboken, NJ (US); Avinoam Kornblit, Highland Park, NJ (US); Thomas Nikita Krupenkin, Middleton, WI (US); Wonsuck Lee, Basking Ridge, NJ (US); Alan Michael Lyons, New Providence, NJ (US); Todd Richard Salamon, Chatham, NJ (US); Brijesh Vyas, Warren, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 206 days.

(21) Appl. No.: 12/080,408

(22) Filed: Mar. 31, 2008

(65) Prior Publication Data

US 2009/0242175 A1 Oct. 1, 2009

(51) Int. Cl.
*F28D 15/00* (2006.01)

(52) U.S. Cl. ..... 165/104.26; 165/104.33; 361/700

(58) Field of Classification Search ..... 165/104.26, 165/104.33; 361/700
See application file for complete search history.

(56) References Cited

U.S. PATENT DOCUMENTS 3,680,189 A * 8/1972 Noren ..... 29/890.032
4,046,190 A * 9/1977 Marcus et al. ..... 165/104.26
4,461,343 A * 7/1984 Token et al. ..... 165/104.26
6,082,443 A * 7/2000 Yamamoto et al. ..... 165/104.26
6,227,287 B1 * 5/2001 Tanaka et al. ..... 165/80.4
6,269,866 B1 * 8/2001 Yamamoto et al. ..... 165/104.26

(Continued)

FOREIGN PATENT DOCUMENTS

JP 6-112380 * 4/1994 ..... 165/104.26

(Continued)

OTHER PUBLICATIONS

Linke et al., "Self-Propelled Leidenfrost Droplets," Physical Review Letters, vol. 96, pp. 154502-1 through 154502-4, Apr. 21, 2006.

(Continued)

*Primary Examiner*—Terrell L McKinnon
(74) *Attorney, Agent, or Firm*—Jay M. Brown

(57) ABSTRACT

Device having first wick evaporator including first membrane and plurality of first thermally-conductive supports. First membrane has upper and lower surfaces. First membrane also has plurality of pores with upper pore ends at upper surface of first membrane and with lower pore ends at lower surface of first membrane. Each of first thermally-conductive supports has upper and lower support ends. Upper support ends of first thermally-conductive supports are in contact with first membrane. Each of first thermally-conductive supports has longitudinal axis extending between the upper and lower support ends, average cross-sectional area along axis, and membrane support cross-sectional area at upper support end, the membrane support cross-sectional area effectively being smaller than average cross-sectional area. First thermally-conductive supports are configured to conduct thermal energy from lower support ends of first thermally-conductive supports to first membrane. Process includes providing wick evaporator, providing liquid working fluid in contact with lower or upper surface of membrane, and causing liquid working fluid to be evaporated from liquid-vapor interface in membrane.

26 Claims, 11 Drawing Sheets

U.S. PATENT DOCUMENTS

| | | | | |
|---|---|---|---|---|
| 6,293,333 | B1 * | 9/2001 | Ponnappan et al. | 165/104.26 |
| 6,397,935 | B1 * | 6/2002 | Yamamoto et al. | 165/104.26 |
| 6,410,982 | B1 * | 6/2002 | Brownell et al. | 257/714 |
| 6,901,994 | B1 * | 6/2005 | Jin-Cherng et al. | 165/104.26 |
| 7,048,889 | B2 | 5/2006 | Arney et al. | 422/68.1 |
| 2004/0067455 | A1 * | 4/2004 | Keevert et al. | 430/377 |
| 2007/0224391 | A1 | 9/2007 | Krupenkin et al. | 428/141 |
| 2007/0240860 | A1 * | 10/2007 | Meyer et al. | 165/104.26 |
| 2007/0267178 | A1 * | 11/2007 | Hou et al. | 165/104.26 |
| 2007/0295486 | A1 * | 12/2007 | Su et al. | 165/104.26 |
| 2008/0174963 | A1 * | 7/2008 | Chang et al. | 361/700 |
| 2009/0025910 | A1 * | 1/2009 | Hoffman et al. | 165/104.26 |
| 2009/0040726 | A1 * | 2/2009 | Hoffman et al. | 361/700 |

FOREIGN PATENT DOCUMENTS

| | | | | |
|---|---|---|---|---|
| JP | 10-238973 | * | 9/1998 | 165/104.26 |
| JP | 11-183067 | * | 7/1999 | 165/104.26 |

OTHER PUBLICATIONS

Henoch et al., "Turbulent Drag Reduction Using Superhydrophobic Surfaces," 3rd AIAA Flow Control Conference, San Francisco, Calif., paper 2006-3192, pp. 1-5, Jun. 5, 2006.

Salamon et al., "Numerical Simulation of Fluid Flow in Microchannels with Superhydrophobic Walls," Proceedings of IMECE2005, IMECE2005-82641, Orlando, Florida, pp. 1-11, Nov. 5, 2005.

U.S. Appl. No. 12/080,409, filed Mar. 31, 2008, Kolodner et al.

* cited by examiner

THERMAL ENERGY TRANSFER DEVICE

BACKGROUND OF THE INVENTION

1. Field of the Invention

This invention generally relates to devices and methods for transferring thermal energy.

2. Related Art

This section introduces aspects that may help facilitate a better understanding of the invention. Accordingly, the statements of this section are to be read in this light and are not to be understood as admissions about what is prior art or what is not prior art.

Various types of devices and methods for transferring thermal energy have been developed. Devices commonly referred to as "heat pipes" or "heat sinks" have been developed for the purpose of removing waste heat or excessive heat from a structure that has either generated or absorbed the heat. Such "heat pipes" and "heat sinks" remove the waste or excessive heat from such structures and transfer the thermal energy elsewhere for end-use, dissipation, or other disposal. Despite these developments, there is a continuing need for improved devices and methods capable of removing thermal energy from a structure and transferring such thermal energy elsewhere.

SUMMARY

In an example of an implementation, a device is provided. The device has a first wick evaporator including a first membrane and a plurality of first thermally-conductive supports. The first membrane has an upper surface and a lower surface. The first membrane also has a plurality of pores with upper pore ends at the upper surface of the first membrane and with lower pore ends at the lower surface of the first membrane. Each of the first thermally-conductive supports has upper and lower support ends. In the device, the upper support ends of the first thermally-conductive supports are in contact with the first membrane. Each of the first thermally-conductive supports has a longitudinal axis extending between the upper and lower support ends, an average cross-sectional area along the axis, and a membrane support cross-sectional area at the upper support end, the membrane support cross-sectional area effectively being smaller than the average cross-sectional area. Further, the first thermally-conductive supports in the device are configured to conduct thermal energy from the lower support ends of the first thermally-conductive supports to the first membrane.

As another example of an implementation, a process is provided. The process includes providing a wick evaporator including a first membrane having an upper surface and a lower surface, and a plurality of pores with upper pore ends at the upper surface of the first membrane and with lower pore ends at the lower surface of the first membrane. Providing the wick evaporator further includes providing a plurality of first thermally-conductive supports each having upper and lower support ends, wherein the upper support ends of the first thermally-conductive supports are in contact with the first membrane. The process also includes positioning the lower support ends of the first thermally-conductive supports in contact with a thermal energy source to conduct thermal energy from the lower support ends to the first membrane. The process further includes providing a liquid working fluid in contact with the lower or upper surface of the first membrane, and causing the liquid working fluid to be evaporated from a liquid-vapor interface in the first membrane.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Devices are provided that have a wick evaporator including a membrane and a plurality of first thermally-conductive supports. The membrane has upper and lower surfaces and a plurality of pores, with upper and lower pore ends respectively at the upper and lower surfaces of the membrane. Each of the first thermally-conductive supports has upper and lower support ends. Each of the first thermally-conductive supports has a longitudinal axis extending between the upper and lower support ends, an average cross-sectional area along the axis, and a membrane support cross-sectional area at the upper support end, the membrane support cross-sectional area effectively being smaller than the average cross-sectional area. The upper support ends are in contact with the membrane. The first thermally-conductive supports are configured to conduct thermal energy from the lower support ends to the membrane. In examples, the device may further include a case having a lower interior surface spaced apart from and facing an upper interior surface of the case, wherein the case is partitioned by the membrane into first and second regions. The first region may, for example, include the lower surface of the membrane, the lower interior surface of the case, and the first thermally-conductive supports. The second region may, as an example, include the upper surface of the membrane and the upper interior surface of the case. The device may further, for example, include a condenser. In that example, the first region may be configured for containing a liquid working fluid for evaporation through the membrane into the second region, and the condenser may be configured for receiving vaporized working fluid from the second region and for returning condensed working fluid to the first region. Alternatively in that example, the second region may be configured for containing a liquid working fluid for evaporation through the membrane into the first region, and the condenser may be configured for receiving vaporized working fluid from the first region and for returning condensed working fluid to the second region. In further examples, the "membrane" may be referred to as a "first membrane", and a device that includes a "first membrane" may, for example, include a second membrane.

Figure 1:
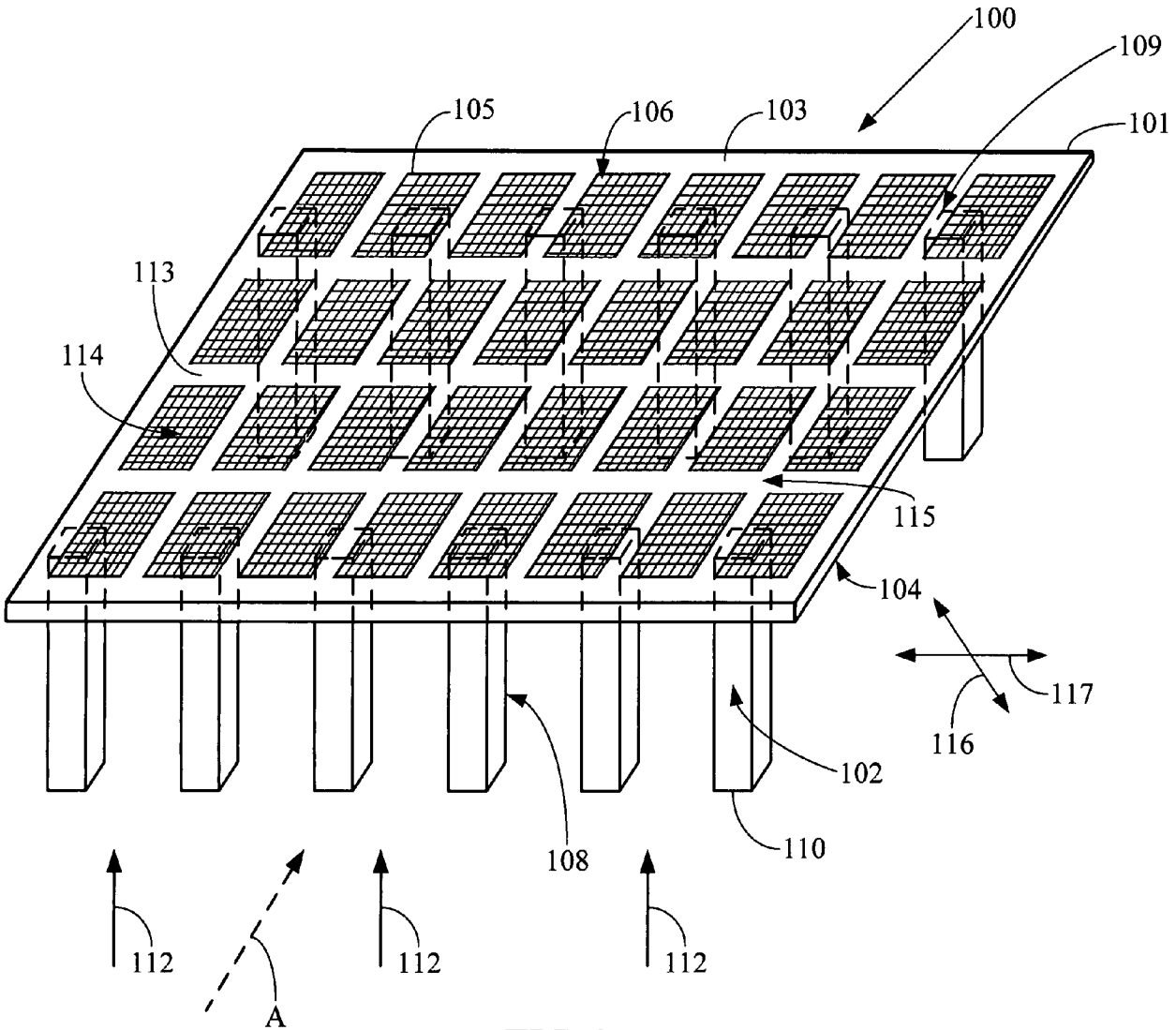
FIG. 1 is a top perspective schematic view showing an example of an implementation of a device.

FIG. 1 is a top perspective schematic view showing an example of an implementation of a device 100. The device 100 has a first wick evaporator that includes a first membrane 101 and a plurality of first thermally-conductive supports 102. The first membrane 101 has an upper surface 103 and a lower surface 104. The first membrane 101 also has a plurality of pores 105 with upper pore ends 106 at the upper surface 103 of the first membrane 101 and with lower pore ends (not shown) at the lower surface 104 of the first membrane 101. Each of the first thermally-conductive supports 102 has an upper support end 109 and a lower support end 110. The upper support ends 109 of the first thermally-conductive supports 102 are in contact with the first membrane 101. The first thermally-conductive supports 102 are configured to conduct thermal energy schematically represented by the arrows 112 from the lower support ends 110 of the first thermally-conductive supports 102 to the first membrane 101. Each of the first thermally-conductive supports 102 may, for example, have an intermediate region 108 between an upper support end 109 and a lower support end 110. In an example, the first thermally-conductive supports 102 may be monolithic with the first membrane 101. Such a monolithic structure may facilitate conduction of thermal energy from the lower support ends 110 of the first thermally-conductive supports 102 to the first membrane 101. In another example, the first membrane 101 and the first thermally-conductive supports 102 may be separate structures suitably secured in mutual thermal contact. In an example, the first membrane 101 may include a structural support grid 113 framing a plurality of sub-regions 114 of the first membrane 101, each membrane sub-region 114 including a plurality of the pores 105. The structural support grid 113 may, for example, include a plurality of beams 115 spanning the first membrane 101 in directions of the arrows 116, 117. In another example (not shown) a plurality of the first thermally-conductive supports 102 may be joined together as a rib.

This paragraph discusses conventions that apply to all membranes and pores disclosed throughout this specification. Any of the pores in any device discussed herein may have the same or different shapes and sizes, and may be uniform or random. As examples, pores may have cross-sections that are square, triangular, honeycomb, circular, elliptical, polygonal, or irregular. Longitudinally, pores may have straight or curved axes or may be tortuous and may meander through a membrane in a random fashion. Dimensions of membranes including support grids, beams, and thermally-conductive supports may each independently be on orders of magnitude of tens of microns (μm) down to nanometers (nm). Membrane pores may, for example, have diameters within a range of between about 1 μm and tens of μm. Membrane beams defining pore walls may have thicknesses, for example, on orders of magnitude of about 200 nm up to tens of μm. Thermally-conductive supports and pores of membranes may have aspect ratios of up to at least or substantially exceeding about twenty to one (20:1), as examples. In an example, a membrane may have a thickness of about 30 μm, with 200 nm thick beams forming pores having diameters of about 5 μm. Membranes including random or tortuous pores may include or omit a structural support grid or support beams, or may have a structural support grid or beams having structures different than the structural support grid 113 and the beams 115, and which are compatible with such pore shapes.

It is understood throughout this specification by those skilled in the art that the term "upper" as applied to a part of a device such as the device 100 designates that the part is above a "lower" part of the device, both parts being as shown in a figure such as FIG. 1. It is understood that such "upper" and "lower" designations refer to examples of relative orientations of such parts of the device. For example, the "upper" and "lower" orientations of parts of a device such as the device 100 may be reversed. It is further understood throughout this specification by those skilled in the art that when a first part of a device such as the device 100 is referred to as being "in contact with" a second part of the device or "in contact with" a second structure, the first part of the device may be directly in contact with the second part or structure or alternatively, one or more intervening parts of the device or other structures may also be present.

Figure 2:
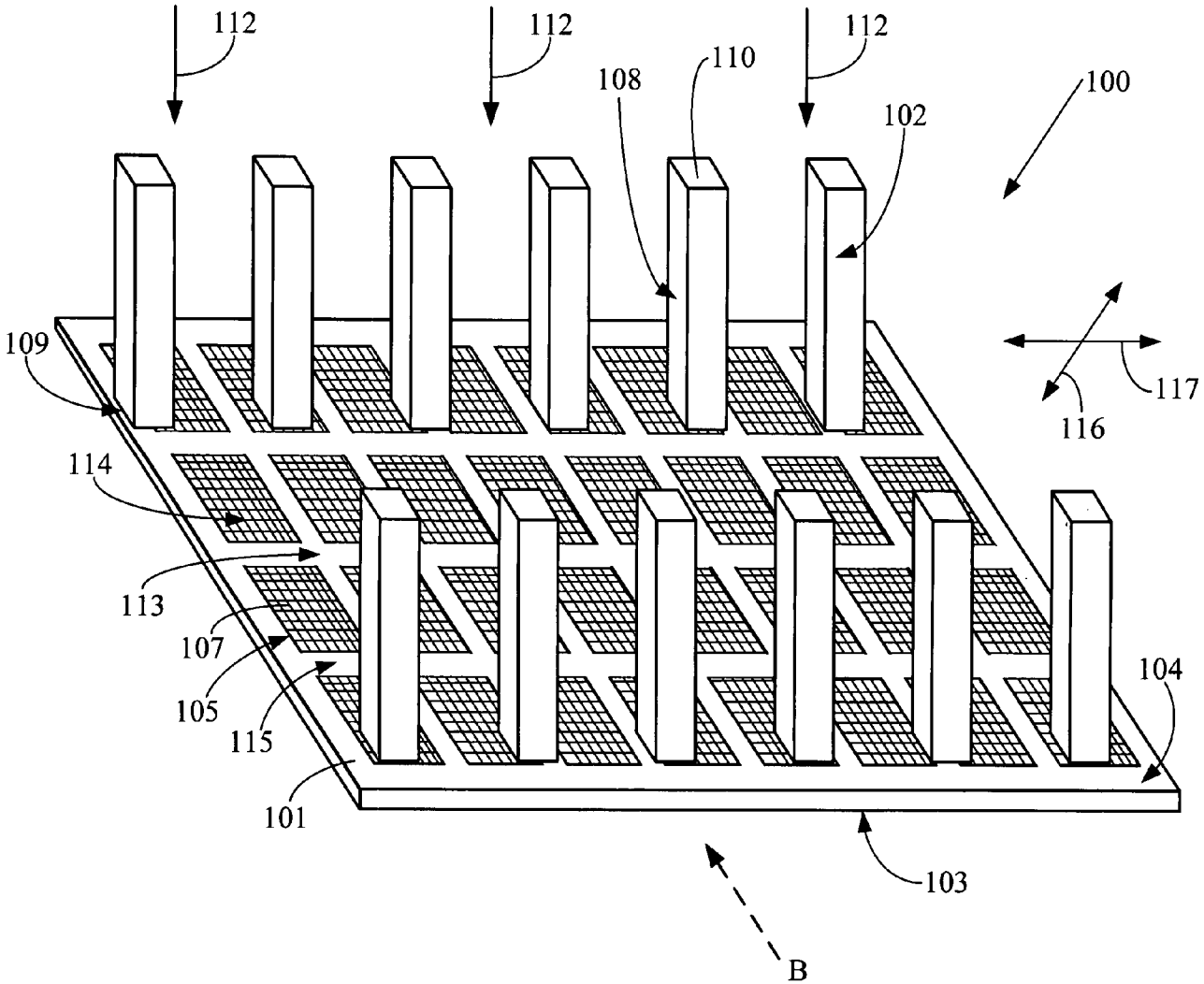
FIG. 2 is a bottom perspective schematic view of the device shown in FIG. 1.

FIG. 2 is a bottom perspective schematic view of the device 100 shown in FIG. 1. The device 100 has a first wick evaporator that includes a first membrane 101 and a plurality of first thermally-conductive supports 102. The first membrane 101 has an upper surface 103 and a lower surface 104. The first membrane 101 also has a plurality of pores 105 with upper pore ends (not shown) at the upper surface 103 of the first membrane 101 and with lower pore ends 107 at the lower surface 104 of the first membrane 101. Each of the first thermally-conductive supports 102 has an upper support end 109 and a lower support end 110. The upper support ends 109 of the first thermally-conductive supports 102 are in contact with the first membrane 101. The first thermally-conductive supports 102 are configured to conduct thermal energy schematically represented by the arrows 112 from the lower support ends 110 of the first thermally-conductive supports 102 to the first membrane 101. Each of the first thermally-conductive supports 102 may have an intermediate region 108 between an upper support end 109 and a lower support end 110. In an example, the first membrane 101 may include a structural support grid 113 framing a plurality of sub-regions 114 of the first membrane 101, each membrane sub-region 114 including a plurality of the pores 105. The structural support grid 113 may, for example, include a plurality of beams 115 spanning the first membrane 101 in directions of the arrows 116, 117.

Figure 3:
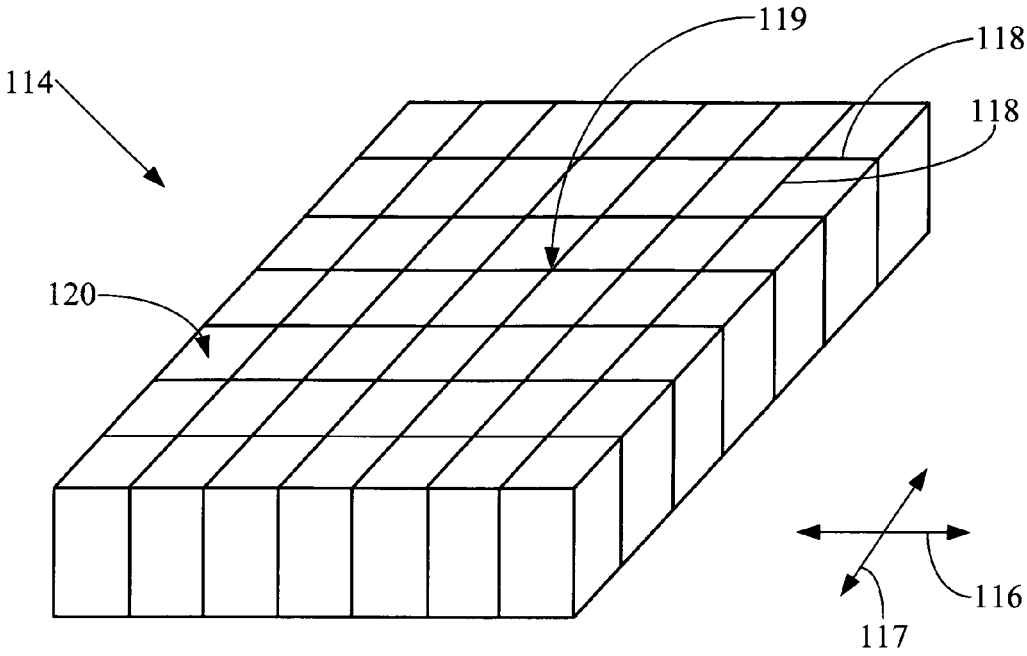
FIG. 3 is a top perspective schematic view showing an example of a sub-region of the device shown in FIG. 1.

FIG. 3 is a top perspective schematic view showing an example of a sub-region 114 of the device 100 shown in FIG. 1. Each of the sub-regions 114 of the first membrane 101 may, as an example, include a plurality of beams 118 spanning the sub-region 114 in directions of the arrows 116, 117 and defining a grid 119 including a plurality of passages 120. The beams 115 may, for example, have first cross-sectional areas larger than second cross-sectional areas of the beams 118. The passages 120 defined by the grid 119 may, for example, each constitute one of the pores 105 communicating with the upper and lower surfaces 103, 104 of the first membrane 101. In another example (not shown), each of the passages 120 may include a plurality of beams spanning the passage 120 in directions of the arrows 116, 117 and defining a further grid including a plurality of smaller passages. The beams spanning each of the passages 120 may, for example, have third cross-sectional areas smaller than the second cross-sectional areas of the beams 118. In that example, the smaller passages may, for example, each constitute one of the pores 105 communicating with the upper and lower surfaces 103, 104 of the first membrane 101. It is understood by those skilled in the art that the first membrane 101 may include one or more additional grids (not shown) formed by beams successively nested in the same manner as the grid 119 of passages 120 is nested in the structural support grid 113.

Figure 4:
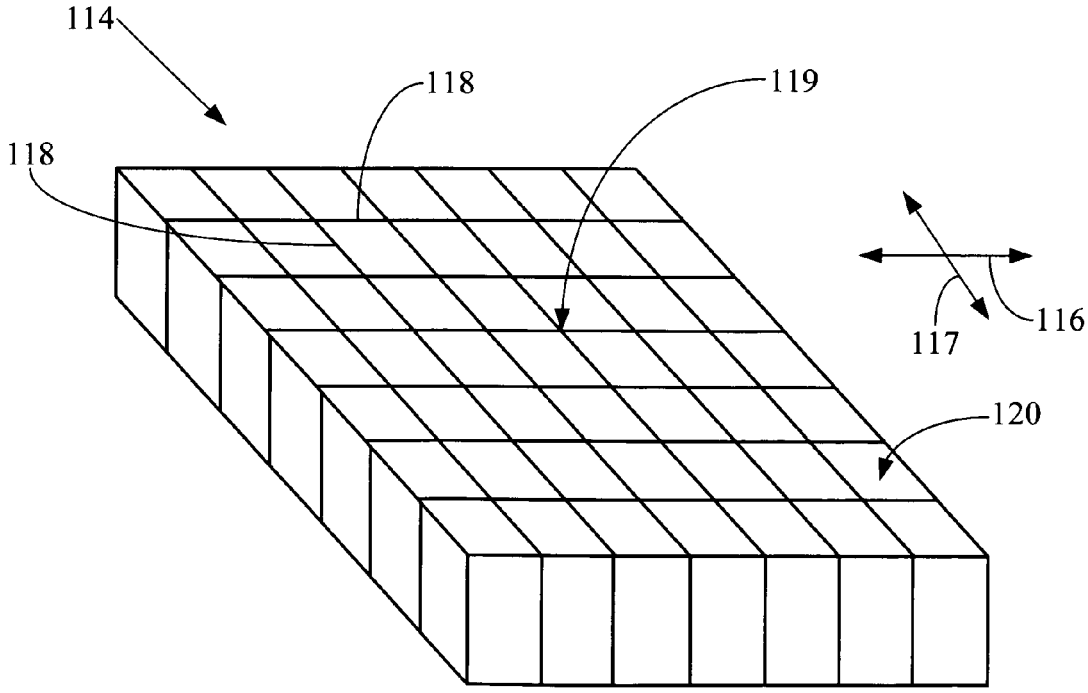
FIG. 4 is a bottom perspective schematic view of the example of a sub-region of the device as shown in FIG. 3.

FIG. 4 is a bottom perspective schematic view of the example of a sub-region 114 of the device 100 as shown in FIG. 3. Each of the sub-regions 114 of the first membrane 101 may, as an example, include a plurality of beams 118 spanning the sub-region 114 in directions of the arrows 116, 117 and defining a grid 119 including a plurality of passages 120. The beams 115 may, for example, have first cross-sectional areas larger than second cross-sectional areas of the beams 118. The passages 120 defined by the grid 119 may, for example, each constitute one of the pores 105 communicating with the upper and lower surfaces 103, 104 of the first membrane 101.

Figure 5:
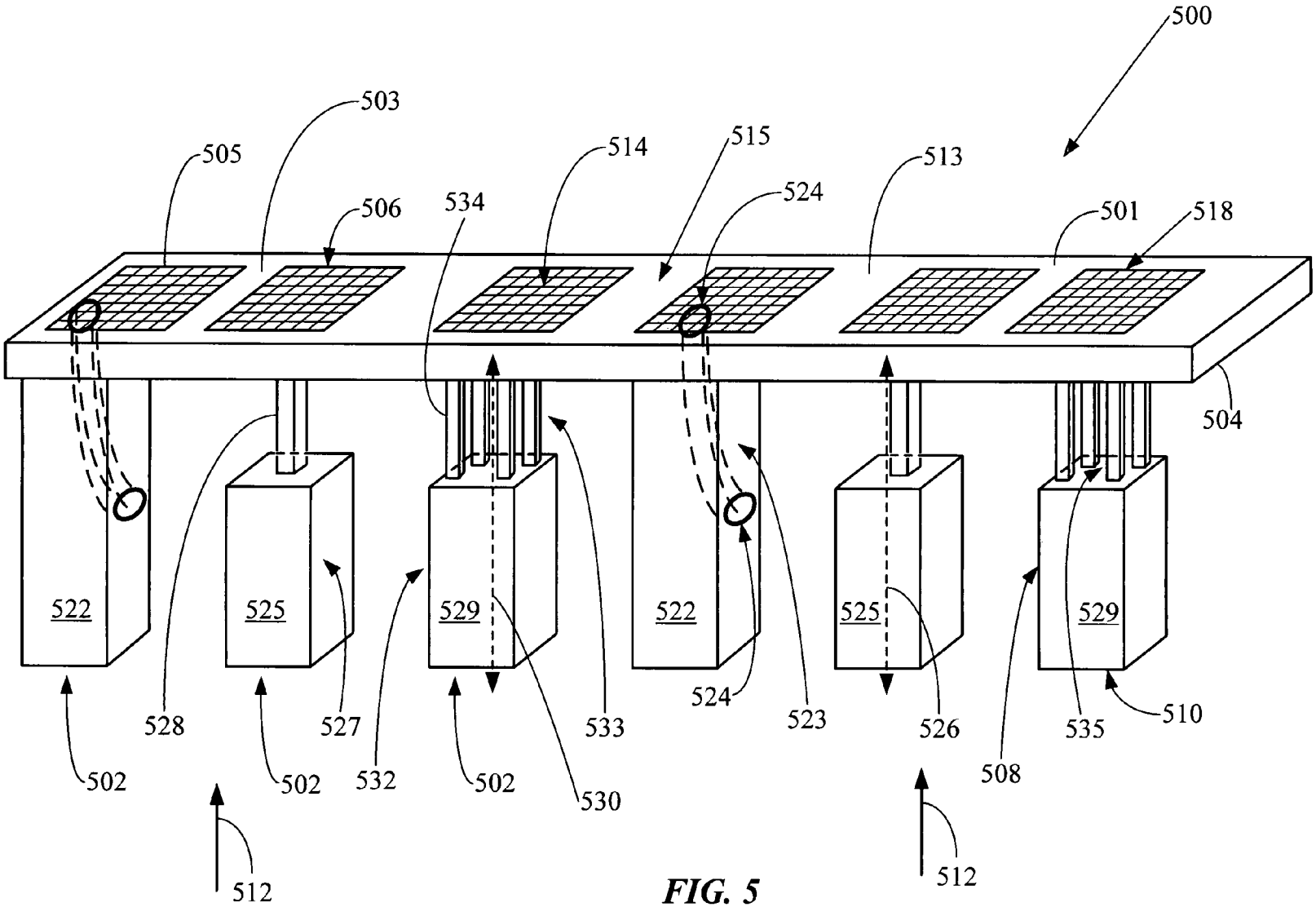
FIG. 5 is a side view, taken from the direction of the arrow A, of part of an example of the device as shown in FIG. 1.

FIG. 5 is a side view, taken from the direction of the arrow A, of part of an example 500 of the device 100 as shown in FIG. 1. The example 500 of the device 100 has a first wick evaporator that includes a first membrane 501 and a plurality of first thermally-conductive supports 502. The first membrane 501 has an upper surface 503 and a lower surface 504. The first membrane 501 also has a plurality of pores 505 with upper pore ends 506 at the upper surface 503 of the first membrane 501 and with lower pore ends (not shown) at the lower surface 504 of the first membrane 501. Each of the first thermally-conductive supports 502 has an upper support end (not shown) and a lower support end 510 in the same manner as shown in FIG. 1. The upper support ends (not shown) of the first thermally-conductive supports 502 are in contact with the lower surface 504 of the first membrane 501. The first thermally-conductive supports 502 are configured to conduct thermal energy schematically represented by the arrows 512 from the lower support ends 510 of the first thermally-conductive supports 502 to the first membrane 501. Each of the first thermally-conductive supports 502 may have an intermediate region 508 between an upper support end (not shown) and a lower support end 510. In an example, the first membrane 501 may include a structural support grid 513 framing a plurality of sub-regions 514 of the first membrane 501, each membrane sub-region 514 including a plurality of the pores 505. The structural support grid 513 may, for example, include a plurality of beams 515 spanning the first membrane 501 in the same manner as shown and discussed above in connection with FIGS. 1-2. Each of the sub-regions 514 of the first membrane 501 may, as an example, include a plurality of further beams including beams 518, spanning the sub-region 514 in the same manner as shown and discussed above in connection with FIGS. 1-2. Each of the first thermally-conductive supports 502 may, for example, have a longitudinal axis 525 extending between the upper support end (not shown) and the lower support end 510, an average cross-sectional area along the axis, and a membrane support cross-sectional area at the upper support end (not shown), the membrane support cross-sectional area effectively being smaller than the average cross-sectional area.

In an example, one or more of the first thermally-conductive supports 502 as may be represented in FIG. 5 by an example 522 of a first thermally-conductive support 502, may have a lateral wall 523 extending between the upper support end (not shown) and the lower support end 510. Further, the example 522 of a first thermally-conductive support may include one or more pores 524 that communicate both with the upper support end (not shown) and with the lateral wall 523. A pore 524 may also communicate with a pore 505, as the upper support end (not shown) of the example 522 of a first thermally-conductive support is in contact with the lower surface 504 of the first membrane 501. In that example, a pore 505 and a pore 524 may collectively form a passageway communicating between the lateral wall 523 of the example 522 of a first thermally-conductive support, and the upper surface 503 of the first membrane 501.

As another example, one or more of the first thermally-conductive supports 502 as may be represented in FIG. 5 by an example 525 of a first thermally-conductive support 502, may have an axis represented by the arrow 526 extending between the upper support end (not shown) and the lower support end 510. The example 525 of a first thermally-conductive support may include a first stage 527 extending along the axis represented by the arrow 526 from the lower support end 510, and a second stage 528 extending along the axis represented by the arrow 526 from the upper support end (not shown). Further, for example, the first stage 527 may have a first cross-sectional area and the second stage 528 may have a second cross-sectional area, wherein the first cross-sectional area is greater than the second cross-sectional area.

In a further example, one or more of the first thermally-conductive supports 502 as may be represented in FIG. 5 by an example 529 of a first thermally-conductive support 502, may have an axis represented by the arrow 530 extending between the upper support end (not shown) and the lower support end 510. The example 529 of a first thermally-conductive support may include a first stage 532 extending along the axis represented by the arrow 530 from the lower support end 510, and a second stage 533 extending along the axis represented by the arrow 530 from the upper support end (not shown). Further, for example, the second stage 533 may include a plurality of intermediate thermally-conductive supports 534 extending between the upper support end (not shown) and the first stage 532. The intermediate thermally-conductive supports 534 may be mutually spaced apart by interstices 535. As a result of the interstices 535, the first stage 532 may have a first cross-sectional area, and the intermediate thermally-conductive supports 534 of the second stage 533 may collectively have a second effective cross-sectional area, wherein the first cross-sectional area is greater than the second cross-sectional area.

Figure 6:
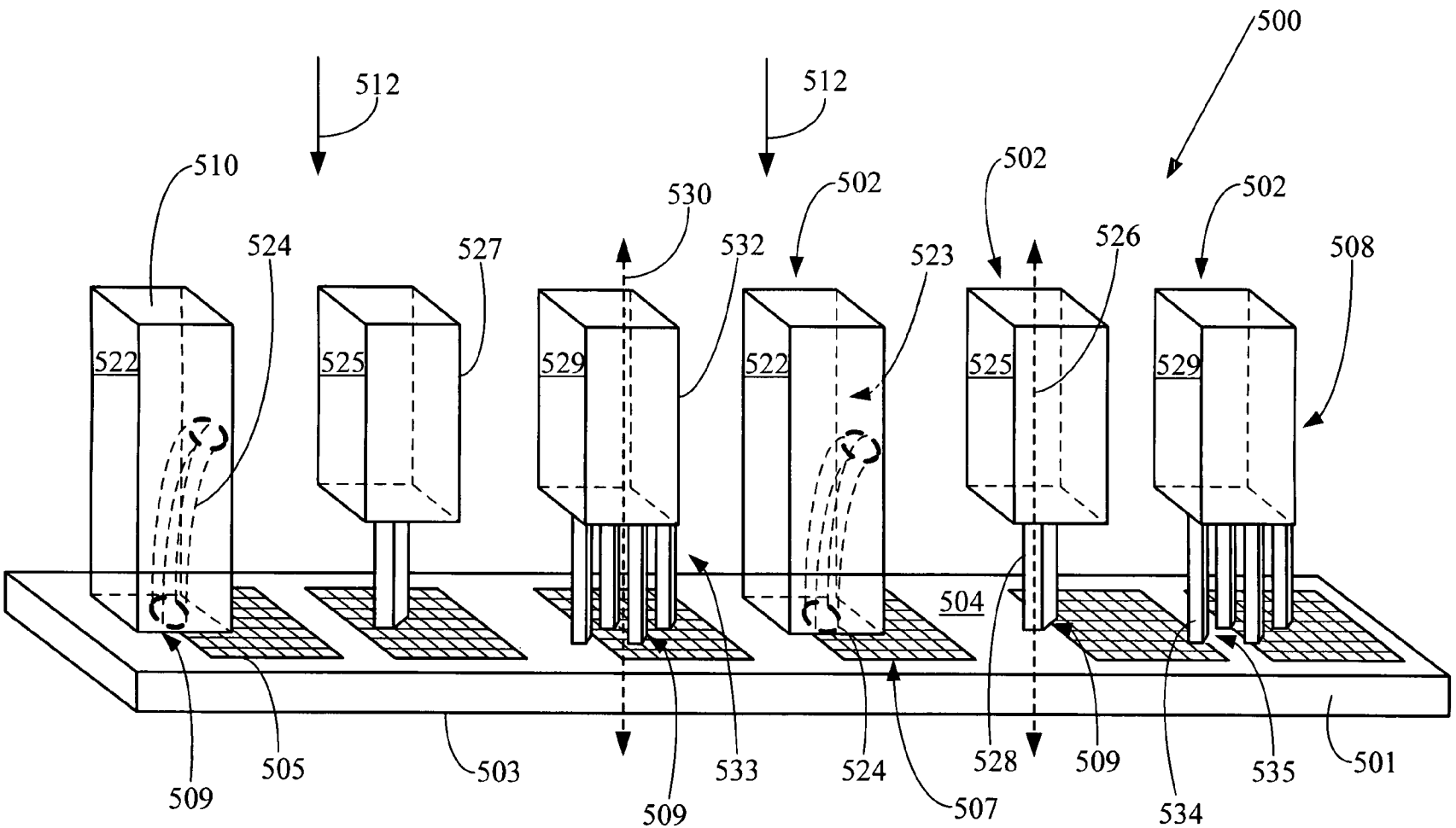
FIG. 6 is a side view, taken from the direction of the arrow B, of part of an example of the device as shown in FIG. 2.

FIG. 6 is a side view, taken from the direction of the arrow B, of part of an example 500 of the device 100 as shown in FIG. 2. The example 500 of the device 100 has a first wick evaporator that includes a first membrane 501 and a plurality of first thermally-conductive supports 502. The first membrane 501 has an upper surface 503 and a lower surface 504. The first membrane 501 also has a plurality of pores 505 with upper pore ends (not shown) at the upper surface 503 of the first membrane 501 and with lower pore ends 507 at the lower surface 504 of the first membrane 501. Each of the first thermally-conductive supports 502 has an upper support end 509 and a lower support end 510. The upper support ends 509 of the first thermally-conductive supports 502 are in contact with the lower surface 504 of the first membrane 501. The first thermally-conductive supports 502 are configured to conduct thermal energy schematically represented by the arrows 512 from the lower support ends 510 of the first thermally-conductive supports 502 to the first membrane 501. Each of the first thermally-conductive supports 502 may have an intermediate region 508 between an upper support end 509 and a lower support end 510.

Each of the first thermally-conductive supports 502 may, for example, have a longitudinal axis 525 extending between the upper support end 509 and the lower support end 510, an average cross-sectional area along the axis 525, and a membrane support cross-sectional area at the upper support end 509, the membrane support cross-sectional area effectively being smaller than the average cross-sectional area.

In an example, one or more of the first thermally-conductive supports 502 as may be represented in FIG. 6 by an example 522 of a first thermally-conductive support 502, may have a lateral wall 523 extending between the upper support end 509 and the lower support end 510. Further, the example 522 of a first thermally-conductive support may include one or more pores 524 that communicate both with the upper support end 509 and with the lateral wall 523. A pore 524 may also communicate with a pore 505, as the upper support end 509 of the example 522 of a first thermally-conductive support is in contact with the lower surface 504 of the first membrane 501. In that example, a pore 505 and a pore 524 may collectively form a passageway communicating between the lateral wall 523 of the example 522 of a first thermally-conductive support, and the upper surface 504 of the first membrane 501.

As another example, one or more of the first thermally-conductive supports 502 as may be represented in FIG. 6 by an example 525 of a first thermally-conductive support 502, may include a first stage 527 extending along the axis represented by the arrow 526 from the lower support end 510, and a second stage 528 extending along the axis represented by the arrow 526 from the upper support end 509. Further, for example, the first stage 527 may have a first cross-sectional area and the second stage 528 may have a second effective cross-sectional area, wherein the first cross-sectional area is greater than the second cross-sectional area. Where the upper support end 509 is, for example, in contact with a membrane sub-region 514, the second cross-sectional area of the second stage 528 may leave some of the pores 505 of the membrane sub-region 514 unobstructed. As another example (not shown), the first stage 527 may have a first density of pores having a first pore size distribution, and the second stage 528 may have a second density of pores or a second pore size distribution, or both such a second density and such a second pore size distribution. In that example, some of the pores may communicate with the membrane 501, and others may not.

In a further example, one or more of the first thermally-conductive supports 502 as may be represented in FIG. 6 by an example 529 of a first thermally-conductive support 502, may include a first stage 532 extending along the axis represented by the arrow 530 from the lower support end 510, and a second stage 533 extending along the axis represented by the arrow 530 from the upper support end 509. Further, for example, the second stage 533 may include a plurality of intermediate thermally-conductive supports 534 extending between the upper support end 509 and the first stage 532. The intermediate thermally-conductive supports 534 may be mutually spaced apart by interstices 535. As a result of the interstices 535, the first stage 532 may have a first cross-sectional area and the intermediate thermally-conductive supports 534 of the second stage 533 may collectively have a second effective cross-sectional area, wherein the first cross-sectional area is greater than the second cross-sectional area. Where the upper support end 509 is, for example, in contact with a membrane sub-region 514, the second cross-sectional area of the intermediate thermally-conductive supports 534 of the second stage 533 may leave some of the pores 505 of the membrane sub-region 514 unobstructed.

Figure 7:
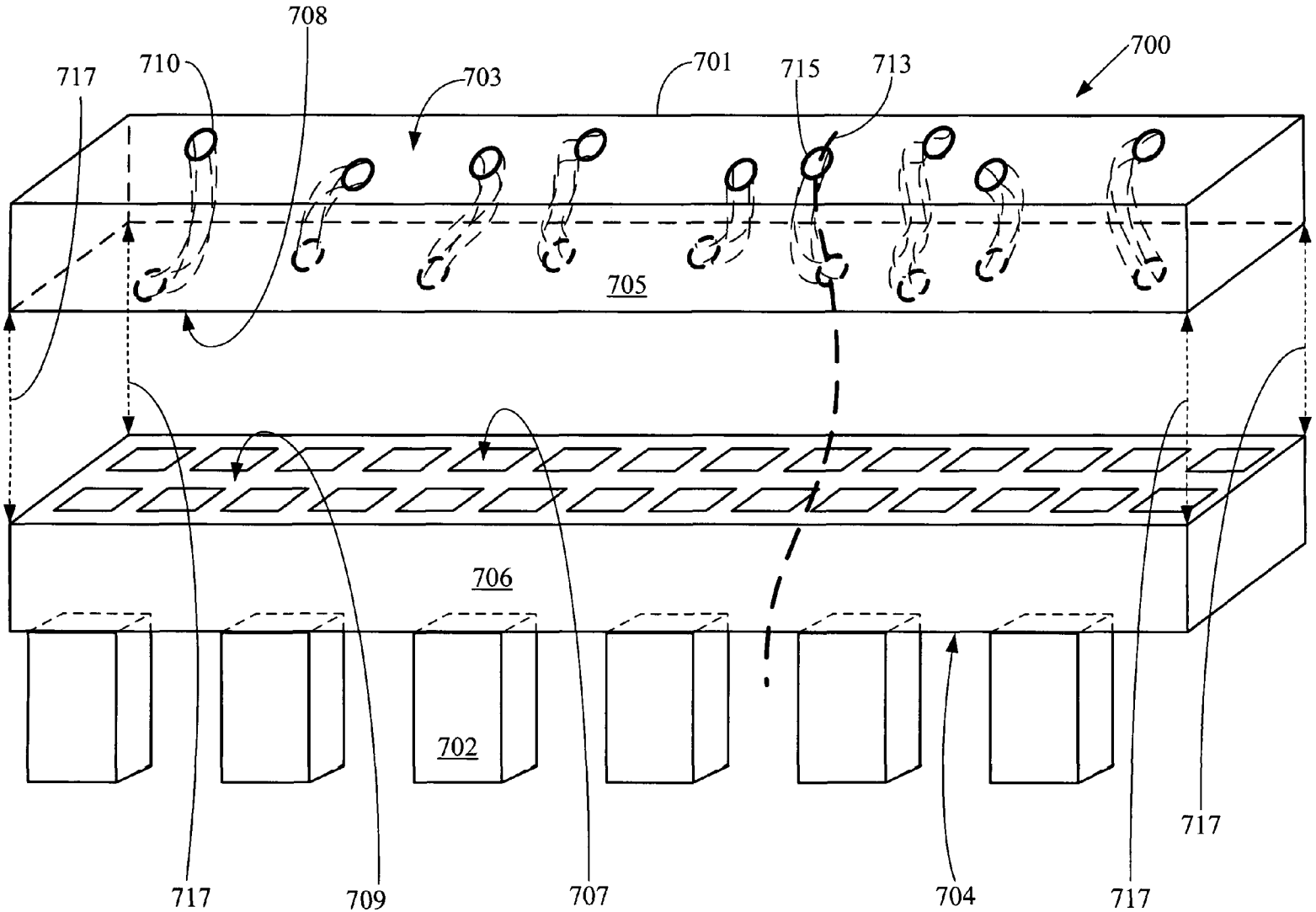
FIG. 7 is an exploded side view taken from the direction of the arrow A of another example of the device shown in FIG. 1.

FIG. 7 is an exploded side view taken from the direction of the arrow A of another example 700 of the device 100 shown in FIG. 1. The example 700 of the device 100 has a first wick evaporator that includes a first membrane 701 and a plurality of first thermally-conductive supports 702. The first membrane 701 has an upper surface 703 and a lower surface 704. The first membrane 701 may include a primary membrane 705 and a secondary membrane 706. FIG. 7 shows the primary membrane 705 and secondary membrane 706 exploded along four dashed lines with arrows 717. The primary membrane 705 includes the upper surface 703 of the first membrane 701 and has a composition including a randomly porous material. The secondary membrane 706 includes the lower surface 704 of the first membrane 701 and has an array of pores 707 each extending between a lower surface 708 of the primary membrane 705 and the lower surface 704 of the first membrane 701. The pores 707 may be spaced apart in a uniform periodicity or in a graduated or random or other arrangement. The secondary membrane 706 may have an upper surface 709; and the surfaces 708, 709 may be in mutual thermal contact. In an example, the primary membrane 705 may include a plurality of random pores 710 communicating with both the upper surface 703 of the primary membrane 705 and with the lower surface 708 of the primary membrane 705. A random pore 710 of the primary membrane 705 and a pore 707 of the secondary membrane 706 may meet at the surfaces 708, 709, together forming a pathway indicated by the dashed curve 713 with a lower pore end (not shown) at the lower surface 704 of the first membrane 701 and with an upper pore end 715 at the upper surface 703 of the first membrane 701. The first thermally-conductive supports 702 included in the example 700 of a device 100 may have structures analogous to the structures of the first thermally-conductive supports 102, 502 discussed above in connection with FIGS. 1-6.

As an example, the primary membrane 705 may have a composition including randomly-porous silicon, the secondary membrane 706 may have a composition including solid silicon in which pores 707 have been formed, and the first thermally-conductive supports 702 may have a composition including solid or porous silicon. For example, the primary membrane 705 may have a randomly-porous structure including pores 710 having a composition including silicon, made porous by an electrochemical process. For example, such randomly-porous silicon-containing materials may be made utilizing technology published by Philips Electronics. Further, for example, the secondary membrane 706 may have an array of pores 707 formed in a material having a composition including silicon, by utilizing photolithography and chemical etching techniques.

Figure 8:
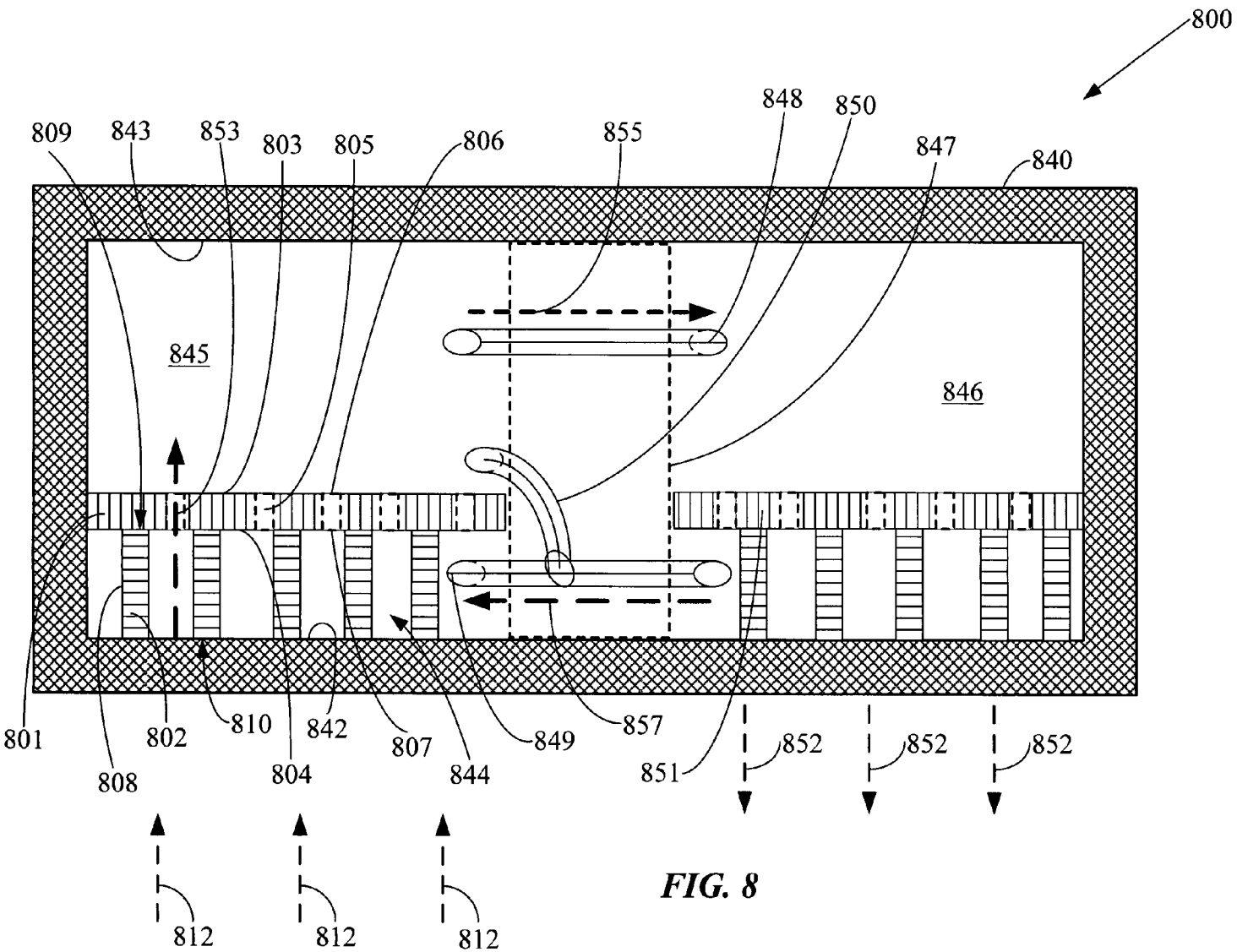
FIG. 8 is a cross-sectional side view of an additional example of a device.

FIG. 8 is a cross-sectional side view of an additional example 800 of a device 100. The example 800 of a device 100 has a first wick evaporator that includes a first membrane 801 and a plurality of first thermally-conductive supports 802. The first membrane 801 has an upper surface 803 and a lower surface 804. The first membrane 801 also has a plurality of pores 805 with upper pore ends 806 at the upper surface 803 of the first membrane 801 and with lower pore ends 807 at the lower surface 804 of the first membrane 801. Each of the first thermally-conductive supports 802 has an upper support end 809 and a lower support end 810. The upper support ends 809 of the first thermally-conductive supports 802 are in contact with the first membrane 801. The first thermally-conductive supports 802 are configured to conduct thermal energy schematically represented by the arrows 812 from the lower support ends 810 of the first thermally-conductive supports 802 to the first membrane 801. Each of the first thermally-conductive supports 802 may have an intermediate region 808 between an upper support end 809 and a lower support end 810. In an example, the first thermally-conductive supports 802 may be monolithic with the first membrane 801. Such a monolithic structure may facilitate conduction of thermal energy from the lower support ends 810 of the first thermally-conductive supports 802 to the first membrane 801. In another example, the first membrane 801 and the first thermally-conductive supports 802 may be separate structures suitably secured in mutual thermal contact. The example 800 of a device 100 may additionally include a case 840 having a lower interior surface 842 spaced apart from and facing an upper interior surface 843 of the case 840. As an example, the first membrane 801 may be monolithic with the first thermally-conductive supports 802 and with the case 840. In another example, the first membrane 801, the first thermally-conductive supports 802, and the case 840 may be separate structures suitably secured in mutual thermal contact. The first membrane 801 may be sized to fit into the case 840, for example, so as to partition the case 840 into first and second regions 844, 845, where the first region 844 may include the lower surface 804 of the first membrane 801, and may include the lower interior surface 842 of the case 840, and may include the first thermally-conductive supports 802; and where the second region 845 may include the upper surface 803 of the first membrane 801.

The example 800 of a device 100 may also include a condenser 846. In an example, the first region 844 may be configured for containing a liquid working fluid (not shown) for evaporation through the first membrane 801 in the direction of the arrow 853 into the second region 845. The condenser 846 may be configured for receiving vaporized working fluid in the direction of the arrow 855 from the second region 845 and for returning condensed working fluid in the direction of the arrow 857 back to the first region 844. As an example, heat flux to the first region 844 from a thermal energy source as indicated by the arrows 812 may drive evaporation of a working fluid (not shown) into the second region 845. In another example, a curved liquid/vapor interface (not shown) within each of the pores 805 may apply a capillary force to a working fluid (not shown) in the first region 844, generating a negative pressure differential in the first region 844 that may pull condensed working fluid back into the first region 844. In an example, the first region 844 may have a surface (not shown) that is substantially smoother than a surface of the second region 845. For example, such a smoother surface may reduce the availability of nucleation sites of the surface for generation of vaporized working fluid within the first region 844. Vaporization of a working fluid within the first region 844 may result in localized drying of the first membrane 801. Localized drying of the first membrane 801 correspondingly reduces the total number of membrane pores 805 from which evaporation occurs, which may reduce the total volume of liquid working fluid that is evaporated through the first membrane 801 into the second region 845. The condenser 846 may be configured to conduct thermal energy out of the case 840 as schematically represented by the arrows 852. For example, the condenser 846 may be in thermal communication with an external cooling device (not shown). FIG. 8 shows an example of an orientation of the condenser 846 relative to the location of the first and second regions 844, 845 in the case 840; other orientations of the condenser 846 may be utilized. In another example (not shown) the example 800 of a device 100 may include a condenser located outside of the case 840. In such a structure, for example, hermetically-sealed fluid flow conduits (not shown) between the case 840 and such a condenser (not shown) may be provided.

The condenser 846 may, for example, include a condenser membrane 851. In further examples, the first membrane 801 and the condenser membrane 851 may each be independently selected to have the structure of one of the membranes 101, 501, 701 earlier discussed. As additional examples, the first membrane 801 and the condenser membrane 851 may each be independently selected to have a randomly porous structure. An example of a membrane having a suitably random porous structure was discussed earlier with respect to the primary membrane 705 shown in FIG. 7.

The example 800 of a device 100 may further include an adiabatic section represented by the dashed rectangle 847, generally located between the condenser 846 and the first and second regions 844, 845. Throughout this specification, the term "adiabatic" means that the device section so designated is not itself actively heated or cooled, although an adiabatic section may be insulated. Throughout this specification, it is understood that any adiabatic section of a device may be substituted by a like structure that is configured for itself being actively heated or cooled. In the example where the first region 844 is configured for containing a liquid working fluid (not shown) for evaporation through the first membrane 801 into the second region 845, and the condenser 846 is configured for receiving vaporized working fluid from the second region 845 and for returning condensed working fluid to the first region 844, the adiabatic section represented by the dashed rectangle 847 may include conduits 848, 849 respectively configured to facilitate such receiving and returning.

Further in that example, the device 800 may be configured for utilizing a working fluid mixture (not shown) that includes a more-volatile fluid and a less-volatile fluid. The less-volatile fluid includes relatively high-boiling molecules; and the more-volatile fluid includes relatively low-boiling molecules. In that example, operation of the device 800 may include continuously cycling the more- and less-volatile fluids through the device 800 in such a manner that the more-volatile fluid may generate a shearing force that may propel the less-volatile fluid through the conduit 849 and back to the first region 844. Additionally in that example, the adiabatic section represented by the dashed rectangle 847 may include conduit 850 configured to selectively return the more-volatile fluid in a vapor phase back to the second region 845. In that configuration, selective return of more-volatile fluid to the second region 845 may keep such more-volatile fluid out of the first region 844 and reduce occurrence of localized drying of the lower membrane surface 804 that may be caused by such more-volatile fluid in a vapor phase. For example, the less-volatile fluid may be evaporated from a liquid phase in the first region 844, through the first membrane 801 into a vapor phase in the second region 845. Then, the less-volatile fluid may be directed through the conduit 848 into the condenser 846 and cooled again to a liquid phase, and then returned through the conduit 849 to the first region 844. Further, for example, the more-volatile fluid may be directed from the second region 845 in a vapor phase through the conduit 848 into the condenser 846 and cooled to a liquid phase, then directed at least partially through the conduit 849, evaporated in the conduit 849 into a vapor phase to propel the less-volatile fluid through the conduit 849, and returned through the conduit 850 to the second region 845.

It is understood that the low-boiling molecules in the more-volatile fluid have a boiling point sufficiently lower than a boiling point of the high-boiling molecules in the less-volatile fluid so that the device 800 may effectively transfer thermal energy during such operation. For example, the high-boiling molecules may have a boiling point of at least about ten (10) degrees Celsius (° C.) higher than a boiling point of the low-boiling molecules. More-volatile working fluids may include, as examples, ammonia and methyl formate, respectively having boiling points of about −33° C. and about 32° C. Relatively less-volatile working fluids may include, as examples, dimethyl ketone and water, respectively having boiling points of about 56° C. and about 100° C. As another example, a more-volatile fluid and a less-volatile fluid may be selected that have a relatively low heat of mixing.

The conduits 848, 849, 850 may, for example, facilitate operation of the device 800 against gravity or a high acceleration force. In another example (not shown), the conduits 848, 849, 850 may be integral with the case 840 and may be configured for providing structural rigidity to the case including protection for the case 840 against a differential pressure external to the case 840.

Figure 9:
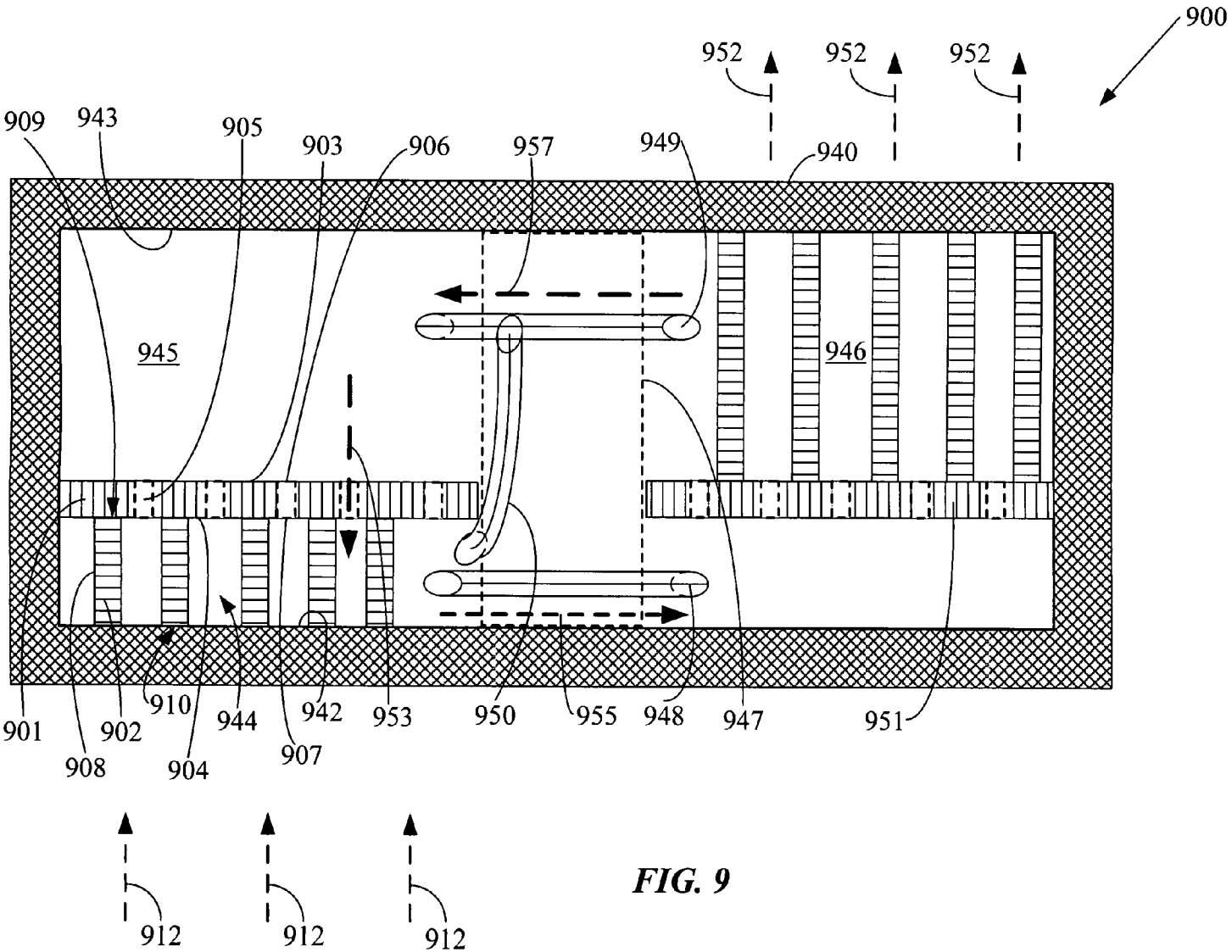
FIG. 9 is a cross-sectional side view of another example of a device.

FIG. 9 is a cross-sectional side view of another example 900 of a device 100. The example 900 of a device 100 has a first wick evaporator that includes a first membrane 901 and a plurality of first thermally-conductive supports 902. The first membrane 901 has an upper surface 903 and a lower surface 904. The first membrane 901 also has a plurality of pores 905 with upper pore ends 906 at the upper surface 903 of the first membrane 901 and with lower pore ends 907 at the lower surface 904 of the first membrane 901. Each of the first thermally-conductive supports 902 may have an intermediate region 908 between an upper support end 909 and a lower support end 910. The upper support ends 909 of the first thermally-conductive supports 902 are in contact with the first membrane 901. The first thermally-conductive supports 902 are configured to conduct thermal energy schematically represented by the arrows 912 from the lower support ends 910 of the first thermally-conductive supports 902 to the first membrane 901. In an example, the first thermally-conductive supports 902 may be monolithic with the first membrane 901. Such a monolithic structure may facilitate conduction of thermal energy from the lower support ends 910 of the first thermally-conductive supports 902 to the first membrane 901. In another example, the first membrane 901 and the first thermally-conductive supports 902 may be separate structures suitably secured in mutual thermal contact. The example 900 of a device 100 may additionally include a case 940 having a lower interior surface 942 spaced apart from and facing an upper interior surface 943 of the case 940. As an example, the first membrane 901 may be monolithic with the first thermally-conductive supports 902 and with the case 940. In another example, the first membrane 901, the first thermally-conductive supports 902, and the case 940 may be separate structures suitably secured in mutual thermal contact. The first membrane 901 may be sized to fit into the case 940, for example, so as to partition the case 940 into first and second regions 944, 945, where the first region 944 may include the lower surface 904 of the first membrane 901, and may include the lower interior surface 942 of the case 940, and may include the first thermally-conductive supports 902; and where the second region 945 may include the upper surface 903 of the first membrane 901.

The example 900 of a device 100 may also include a condenser 946. In an example, the second region 945 may be configured for containing a liquid working fluid (not shown) for evaporation through the first membrane 901 in the direction of the arrow 953 into the first region 944. The condenser 946 may be configured for receiving vaporized working fluid in the direction of the arrow 955 from the first region 944 and for returning condensed working fluid in the direction of the arrow 957 to the second region 945. As an example, heat flux to the second region 945 from a thermal energy source as indicated by the arrows 912 may drive the evaporation of a working fluid (not shown) into the first region 944. In another example, a curved liquid/vapor interface (not shown) within each of the pores 905 may apply a capillary force to a working fluid (not shown) in the second region 945, generating a negative pressure differential in the second region 945 that may pull condensed working fluid back into the second region 945. As an example, the second region 945 may have a surface (not shown) that is substantially smoother than a surface of the first region 944. For example, such a smoother surface may reduce the availability of nucleation sites of the surface for generation of vaporized working fluid within the second region 945. The condenser 946 may be configured to conduct thermal energy out of the case 940 as schematically represented by the arrows 952. For example, the condenser 946 may be in thermal communication with an external cooling device (not shown). FIG. 9 shows an example of an orientation of the condenser 946 relative to the location of the first and second regions 944, 945 in the case 940; other orientations of the condenser 946 may be utilized. In another example (not shown) the example 900 of a device 100 may include a condenser located outside of the case 940. The condenser 946 may, for example, include a condenser membrane 951. In further examples, the first membrane 901 and the condenser membrane 951 may each independently be selected to have the structure of one of the membranes 101, 501, 701, 801 earlier discussed. As additional examples, the first membrane 901 and the condenser membrane 951 may each independently be selected to have a randomly porous structure.

The example 900 of a device 100 may further include an adiabatic section represented by the dashed rectangle 947, generally located between the condenser 946 and the first and second regions 944, 945. In the example where the second region 945 is configured for containing a liquid working fluid (not shown) for evaporation through the first membrane 901 into the first region 944, and the condenser 946 is configured for receiving vaporized working fluid from the first region 944 and for returning condensed working fluid to the second region 945, the adiabatic section represented by the dashed rectangle 947 may include conduits 948, 949 respectively configured to facilitate such receiving and returning.

In that example, operation of the device 900 may include continuously cycling the more- and less-volatile fluids through the device 900 in such a manner that the more-volatile fluid may generate a shearing force that may propel the less-volatile fluid through the conduit 949 and back to the second region 945. Additionally in that example, the adiabatic section represented by the dashed rectangle 947 may include conduit 950 configured to selectively return the more-volatile fluid in a vapor phase back to the first region 944. In that configuration, selective return of more-volatile fluid to the first region 944 may keep such more-volatile fluid out of the second region 945 and reduce occurrence of localized drying of the upper membrane surface 903 that may be caused by such more-volatile fluid in a vapor phase. For example, the less-volatile fluid may be evaporated from a liquid phase in the second region 945, through the first membrane 901 into a vapor phase in the first region 944. Then, the less-volatile fluid may be directed through the conduit 948 into the condenser 946 and cooled again to a liquid phase, and then returned through the conduit 949 to the second region 945. Further, for example, the more-volatile fluid may be directed from the first region 944 in a vapor phase through the conduit 948 into the condenser 946 and cooled to a liquid phase, then directed at least partially through the conduit 949, evaporated in the conduit 949 into a vapor phase to propel the less-volatile fluid through the conduit 949, and returned through the conduit 950 to the first region 944.

The conduits 948, 949, 950 may, for example, facilitate operation of the device 900 against gravity or a high acceleration force. In another example (not shown), the conduits 948, 949, 950 may be integral with the case 940 and may be configured for providing structural rigidity to the case including protection for the case 940 against a differential pressure external to the case 940.

Figure 10:
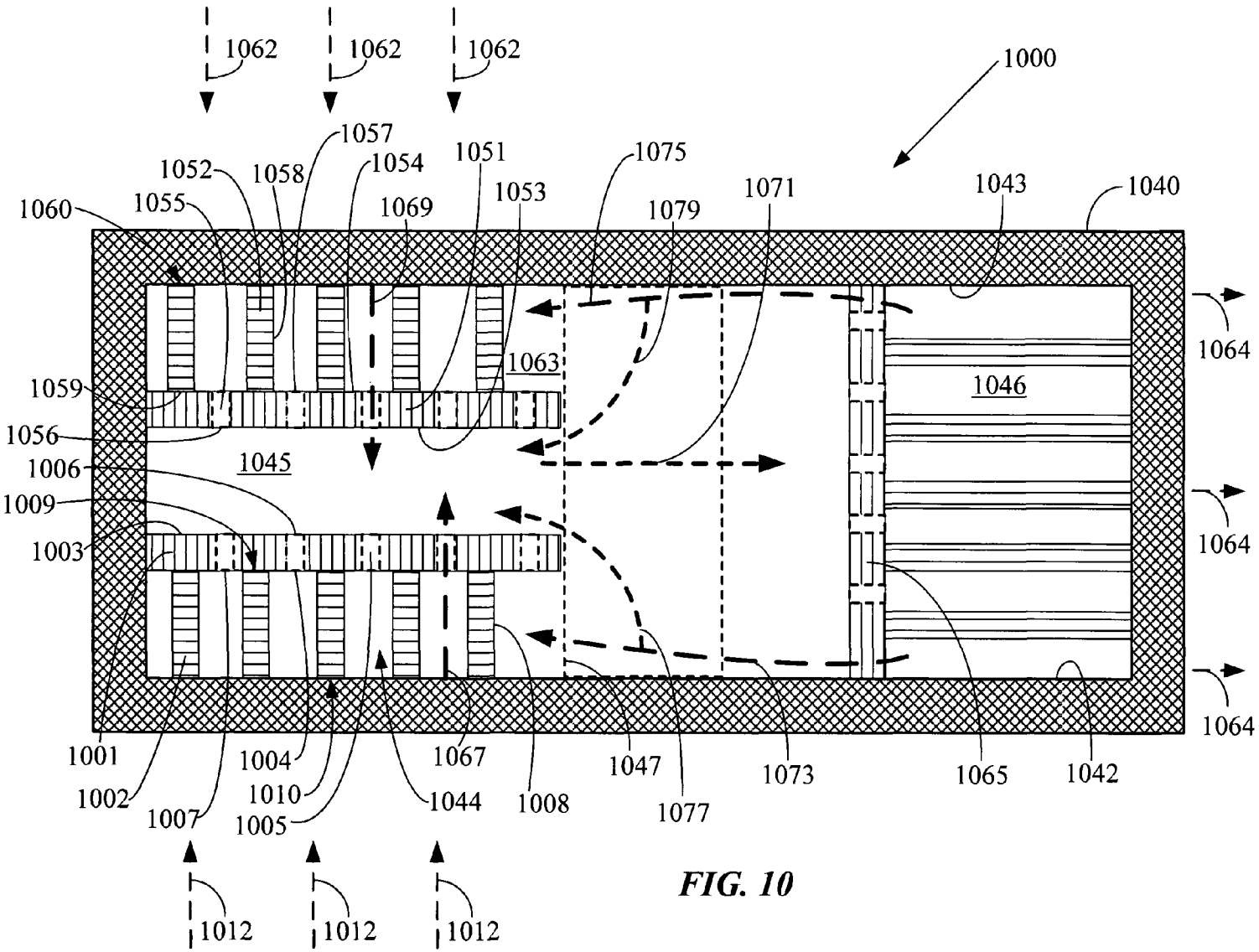
FIG. 10 is a cross-sectional side view of an additional example of a device.

FIG. 10 is a cross-sectional side view of an additional example 1000 of a device 100. The example 1000 of a device 100 has a first wick evaporator that includes a first membrane 1001 and a plurality of first thermally-conductive supports 1002. The first membrane 1001 has an upper surface 1003 and a lower surface 1004. The first membrane 1001 also has a plurality of pores 1005 with upper pore ends 1006 at the upper surface 1003 of the first membrane 1001 and with lower pore ends 1007 at the lower surface 1004 of the first membrane 1001. Each of the first thermally-conductive supports 1002 may have an intermediate region 1008 between an upper support end 1009 and a lower support end 1010. The upper support ends 1009 of the first thermally-conductive supports 1002 are in contact with the first membrane 1001. The first thermally-conductive supports 1002 are configured to conduct thermal energy schematically represented by the arrows 1012 from the lower support ends 1010 of the first thermally-conductive supports 1002 to the first membrane 1001. The example 1000 of a device 100 also has a second wick evaporator that includes a second membrane 1051 and a plurality of second thermally-conductive supports 1052. The second membrane 1051 has an upper surface 1053 and a lower surface 1054. The second membrane 1051 also has a plurality of pores 1055 with upper pore ends 1056 at the upper surface 1053 of the second membrane 1051 and with lower pore ends 1057 at the lower surface 1054 of the second membrane 1051. Each of the second thermally-conductive supports 1052 may have an intermediate region 1058 between an upper support end 1059 and a lower support end 1060. The upper support ends 1059 of the second thermally-conductive supports 1052 are in contact with the second membrane 1051. The second thermally-conductive supports 1052 are configured to conduct thermal energy schematically represented by the arrows 1062 from the lower support ends 1060 of the second thermally-conductive supports 1052 to the second membrane 1051.

The example 1000 of a device 100 may additionally include a case 1040 having a lower interior surface 1042 spaced apart from and facing an upper interior surface 1043 of the case 1040. The first and second membranes 1001, 1051 may be sized to fit into the case 1040, for example, so as to partition the case 1040 into first, second and third regions 1044, 1045, 1063. In that example, the first region 1044 may include the lower surface 1004 of the first membrane 1001, and may include the lower interior surface 1042 of the case 1040, and may include the first thermally-conductive supports 1002. Further in that example, the second region 1045 may include the upper surface 1003 of the first membrane 1001, and may include the upper surface 1053 of the second membrane. Additionally in that example, the third region 1063 may include the lower surface 1054 of the second membrane 1051, and may include the upper interior surface 1043 of the case 1040. In an example, either or both of the first and third regions 1044, 1063 may have a surface (not shown) that is substantially smoother than a surface of the second region 1045.

The example 1000 of a device 100 may also include a condenser 1046. In an example, each of the first and third regions 1044, 1063 may be configured for containing a liquid working fluid (not shown) for evaporation through the first and second membranes 1001, 1051 in the directions of arrows 1067, 1069 respectively into the second region 1045. Further in that example, the condenser 1046 may be configured for receiving vaporized working fluid as schematically represented by the arrow 1071 from the second region 1045 and for returning condensed working fluid to either or both of the first and third regions 1044, 1063 as schematically represented by arrows 1073, 1075 respectively. As an example, heat flux to the first and third regions 1044, 1063 from thermal energy sources as indicated by the arrows 1012, 1062 may drive evaporation of a working fluid (not shown) into the second region 1045. In another example, a curved liquid/vapor interface (not shown) within each of the pores 1005, 1055 may apply a capillary force to a working fluid (not shown) in the first and third regions 1044, 1063, generating a negative pressure differential in the first and third regions 1044, 1063 that may pull condensed working fluid back into the first and third regions 1044, 1063. The condenser 1046 may be configured to conduct thermal energy out of the case 1040 as schematically represented by the arrows 1064. For example, the condenser 1046 may be in thermal communication with an external cooling device (not shown). FIG. 10 shows an example of an orientation of the condenser 1046 relative to the location of the first, second and third regions 1044, 1045, 1063 in the case 1040; other orientations of the condenser 1046 may be utilized. In another example (not shown) the example 1000 of a device 100 may include a condenser located outside of the case 1040. The condenser 1046 may, for example, include a condenser membrane 1065. In further examples, the first and second membranes 1001, 1051 and the condenser membrane 1065 may each independently be selected to have the structure of one of the membranes 101, 501, 701, 801 earlier discussed. As additional examples, the first and second membranes 1001, 1051 and the condenser membrane 1065 may each independently be selected to have a randomly porous structure.

The example 1000 of a device 100 may further include an adiabatic section represented by the dashed rectangle 1047. In an example, the adiabatic section represented by the dashed rectangle 1047 may be located between on the one hand the first, second and third regions 1044, 1045, 1063, and on the other hand the condenser 1046. In an example, the first and third regions 1044, 1063 may be configured for containing a liquid working fluid (not shown) for evaporation through the first and second membranes 1001, 1051 respectively into the second region 1045, and the condenser 1046 may be configured for receiving vaporized working fluid from the second region 1045 and for returning condensed working fluid to the first and third regions 1044, 1063. In that example, the adiabatic section represented by the dashed rectangle 1047 may include conduits (not shown) configured to facilitate such receiving and returning. Further in that example, the device 1000 may be configured for utilizing a working fluid mixture (not shown) including a more-volatile fluid and a less-volatile fluid. In that example, operation of the device 1000 may include continuously cycling the more-volatile fluid through the device 1000 in a manner analogous to the discussions earlier in connection with FIGS. 8-9, to vaporize and generate a shearing force that may move liquid phase less-volatile fluid in directions of the arrows 1073, 1075 and back to the first and third regions 1044, 1063. Additionally in that example, the adiabatic section represented by the dashed rectangle 1047 may include conduits (not shown) configured to selectively vaporize and return the more-volatile fluid as schematically represented by the arrows 1077, 1079 back to the second region 1045. The conduits (not shown) may, for example, facilitate operation of the device 1000 against gravity or a high acceleration force.

Figure 11:
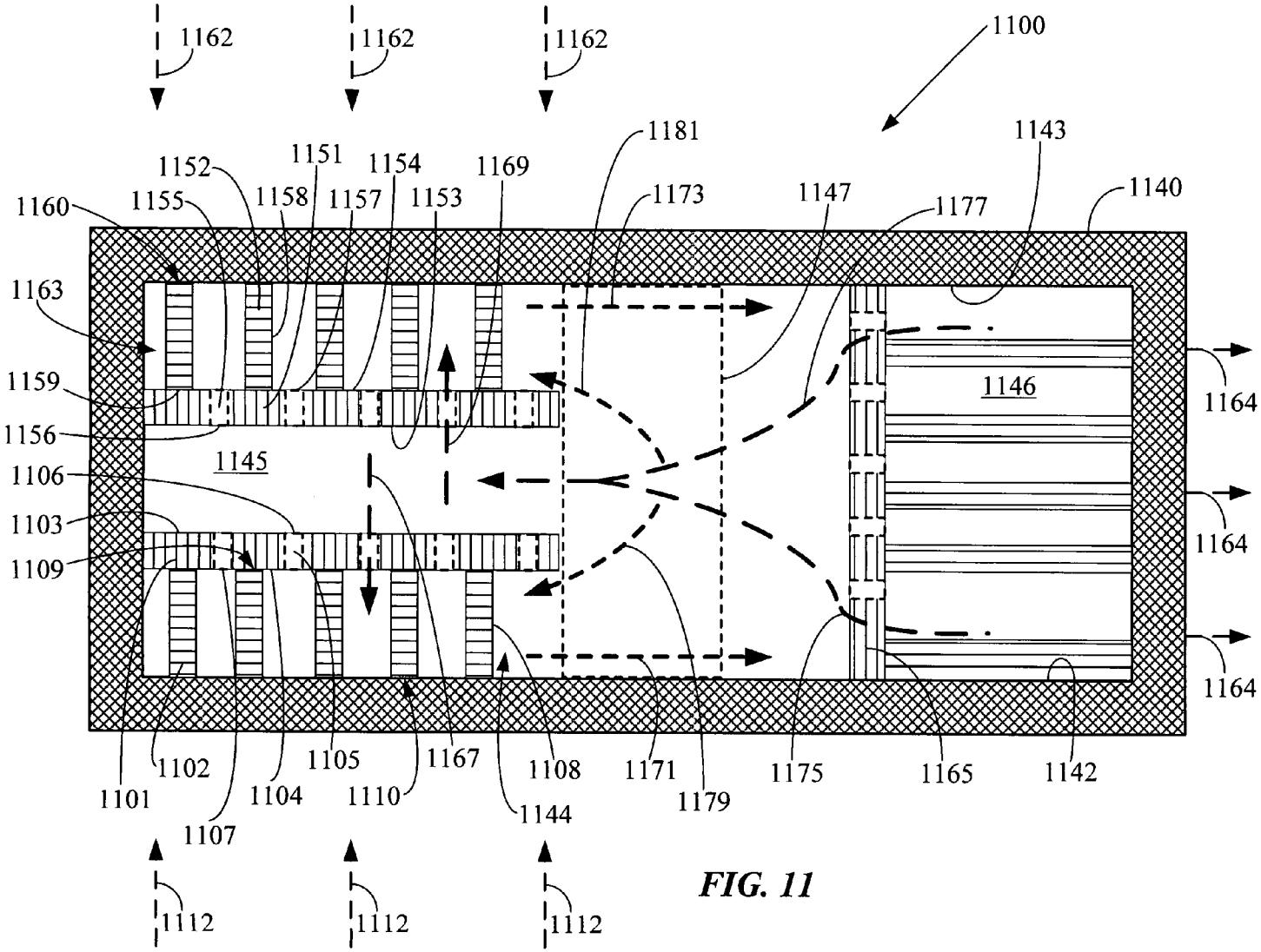
FIG. 11 is a cross-sectional side view of a further example of a device.

FIG. 11 is a cross-sectional side view of a further example 1100 of a device 100. The example 1100 of a device 100 has a first wick evaporator that includes a first membrane 1101 and a plurality of first thermally-conductive supports 1102. The first membrane 1101 has an upper surface 1103 and a lower surface 1104. The first membrane 1101 also has a plurality of pores 1105 with upper pore ends 1106 at the upper surface 1103 of the first membrane 1101 and with lower pore ends 1107 at the lower surface 1104 of the first membrane 1101. Each of the first thermally-conductive supports 1102 may have an intermediate region 1108 between an upper support end 1109 and a lower support end 1110. The upper support ends 1109 of the first thermally-conductive supports 1102 are in contact with the first membrane 1101. The first thermally-conductive supports 1102 are configured to conduct thermal energy schematically represented by the arrows 1112 from the lower support ends 1110 of the first thermally-conductive supports 1102 to the first membrane 1101. The example 1100 of a device 100 also has a second wick evaporator that includes a second membrane 1151 and a plurality of second thermally-conductive supports 1152. The second membrane 1151 has an upper surface 1153 and a lower surface 1154. The second membrane 1151 also has a plurality of pores 1155 with upper pore ends 1156 at the upper surface 1153 of the second membrane 1151 and with lower pore ends 1157 at the lower surface 1154 of the second membrane 1151. Each of the second thermally-conductive supports 1152 has an upper support end 1159 and a lower support end 1160. The upper support ends 1159 of the second thermally-conductive supports 1152 are in contact with the second membrane 1151. The second thermally-conductive supports 1152 are configured to conduct thermal energy schematically represented by the arrows 1162 from the lower support ends 1160 of the second thermally-conductive supports 1152 to the second membrane 1151. Each of the second thermally-conductive supports 1152 may have an intermediate region 1158 between an upper support end 1159 and a lower support end 1160.

The example 1100 of a device 100 may additionally include a case 1140 having a lower interior surface 1142 spaced apart from and facing an upper interior surface 1143 of the case 1140. The first and second membranes 1101, 1151 may be sized to fit into the case 1140, for example, so as to partition the case 1140 into first, second and third regions 1144, 1145, 1163. In that example, the first region 1144 may include the lower surface 1104 of the first membrane 1101, and may include the lower interior surface 1142 of the case 1140, and may include the first thermally-conductive supports 1102. Further in that example, the second region 1145 may include the upper surface 1103 of the first membrane 1101, and may include the upper surface 1153 of the second membrane. Additionally in that example, the third region 1163 may include the lower surface 1154 of the second membrane 1151, and may include the upper interior surface 1143 of the case 1140. As an example, the second region 1145 may have a surface (not shown) that is substantially smoother than a surface in either or both of the first and third regions 1144, 1163.

The example 1100 of a device 100 may also include a condenser 1146. In an example, the second region 1145 may be configured for containing a liquid working fluid (not shown) for evaporation through the first and second membranes 1101, 1151 in directions of arrows 1167, 1169 respectively into the first and third regions 1144, 1163. Further in that example, the condenser 1146 may be configured for receiving vaporized working fluid as schematically represented by arrows 1171, 1173 from the first and third regions 1144, 1163 and for returning condensed working fluid as schematically represented by arrows 1175, 1177 to the second region 1145. As an example, heat flux to the second region 1145 from thermal energy sources as indicated by the arrows 1112, 1162 may drive evaporation of a working fluid (not shown) into the first and third regions 1144, 1163. In another example, a curved liquid/vapor interface (not shown) within each of the pores 1105, 1155 may apply a capillary force to a working fluid (not shown) in the second region 1145, generating a negative pressure differential in the second region 1145 that may pull condensed working fluid back into the second region 1145. The condenser 1146 may be configured to conduct thermal energy out of the case 1140 as schematically represented by the arrows 1164. For example, the condenser 1146 may be in thermal communication with an external cooling device (not shown). FIG. 11 shows an example of an orientation of the condenser 1146 relative to the location of the first, second and third regions 1144, 1145, 1163 in the case 1140; other orientations of the condenser 1146 may be utilized. In another example (not shown) the example 1100 of a device 100 may include a condenser located outside of the case 1140. The condenser 1146 may, for example, include a condenser membrane 1165. In further examples, the first and second membranes 1101, 1151 and the condenser membrane 1165 may each independently be selected to have the structure of one of the membranes 101, 501, 701, 801 earlier discussed. As additional examples, the first and second membranes 1101, 1151 and the condenser membrane 1165 may each independently be selected to have a randomly porous structure.

The example 1100 of a device 100 may further include an adiabatic section represented by the dashed rectangle 1147. In an example, the adiabatic section represented by the dashed rectangle 1147 may be located between on the one hand the first, second and third regions 1144, 1145, 1163, and on the other hand the condenser 1146. In an example, the second region 1145 may be configured for containing a liquid working fluid (not shown) for evaporation through the first and second membranes 1101, 1151 respectively into the first and third regions 1144, 1163, and the condenser 1146 may be configured for receiving vaporized working fluid from the first and third regions 1144, 1163 and for returning condensed working fluid to the second region 1145. In that example, the adiabatic section represented by the dashed rectangle 1147 may include conduits (not shown) configured to facilitate such receiving and returning. Further in that example, the device 1100 may be configured for utilizing a working fluid mixture (not shown) including a more-volatile fluid and a less-volatile fluid. In that example, operation of the device 1100 may include continuously cycling the more-volatile fluid through the device 1100 to vaporize and generate a shearing force that may move liquid phase less-volatile fluid along directions of the arrows 1175, 1177 and back to the second region 1145. Additionally in that example, the adiabatic section represented by the dashed rectangle 1147 may be configured to selectively vaporize and return the more-volatile fluid as schematically represented by arrows 1179, 1181 back to the first and third regions 1144, 1163. The conduits (not shown) may, for example, facilitate operation of the device 1100 against gravity or a high acceleration force.

Overall dimensions of the devices 100, 500, 700, 800, 900, 1000, 1100 may, as examples, include lengths and widths on the order of tens of centimeters (cm), and a thickness on the order of about ten (10) millimeters (mm) or less. For example, a device 100, 500, 700, 800, 900, 1000, 1100 may have a width of about 10 cm, a length of about 20 cm, and a thickness less than 1 mm or as large as may be selected.

Materials for forming devices 100, 500, 700, 800, 900, 1000, 1100 may include, as examples, silicon, silicon carbide (SiC), graphite, aluminum oxide, porous silicon, inorganic dielectrics including Group III-V semiconductors as examples, high temperature polymers, liquid crystal polymers, metal elements and alloys including copper and copper-tungsten as examples, and anisotropic heat-conductive materials. Materials having high coefficients of thermal conductivity may be selected, for example. Monolithic structures in devices 100, 500, 700, 800, 900, 1000, 1100 as discussed above may, for example, increase efficiency of transfer of thermal energy by such devices. Devices 100, 500, 700, 800, 900, 1000, 1100 may include inorganic oxide surfaces for wettability by a working fluid (not shown). The devices 100, 500, 700, 800, 900, 1000, 1100 may be fabricated utilizing various processes including, as examples, deep submicron lithography and pattern transfer etching. Further, for example, randomly-porous silicon—fabrication technology published, as an example, by Philips Electronics, may be utilized.

Figure 12:
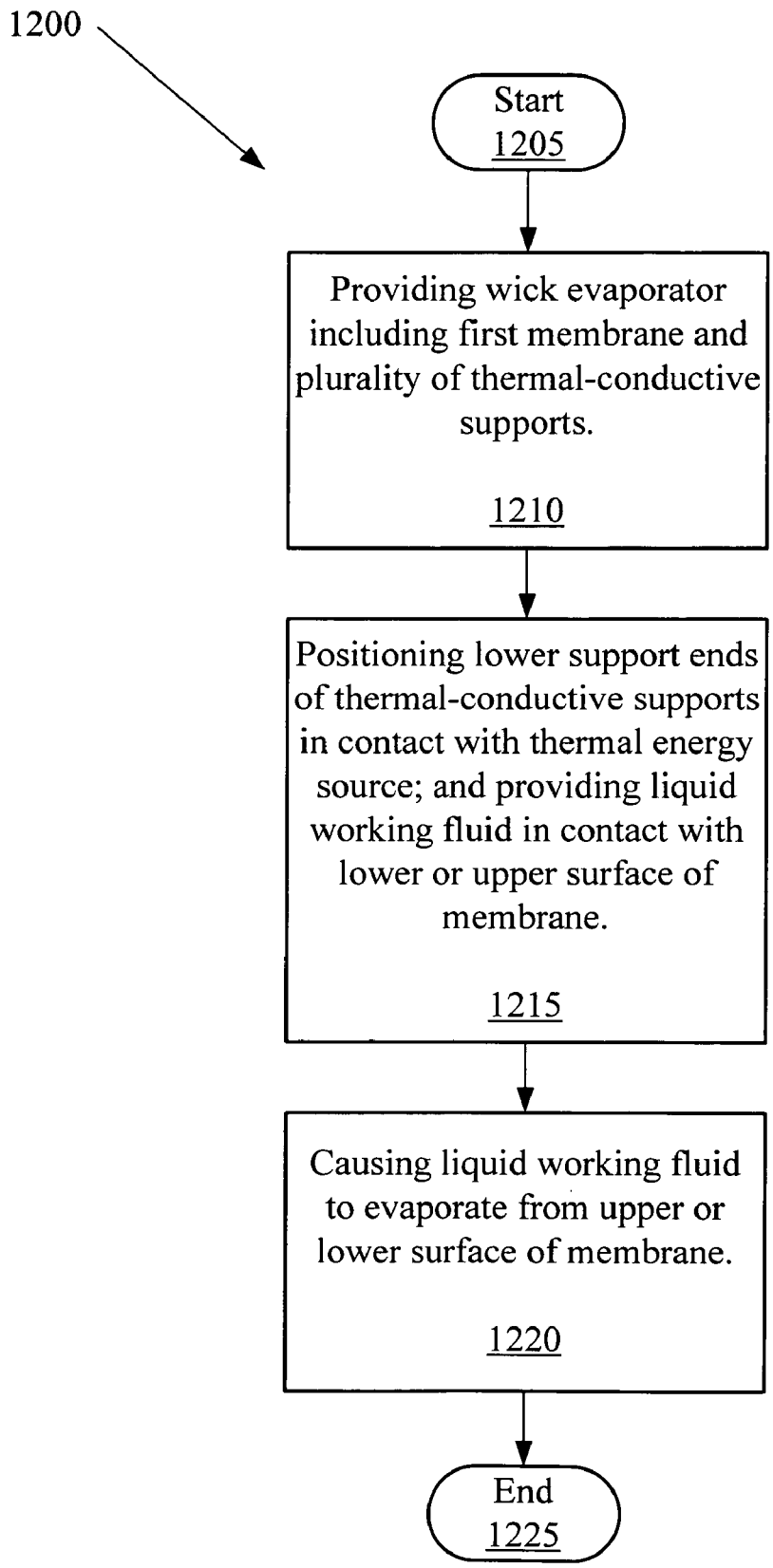
FIG. 12 is a flow chart showing an example of an implementation of a process.

FIG. 12 is a flow chart showing an example of an implementation of a process 1200. The process 1200 starts at step 1205, and then step 1210 includes providing a wick evaporator including a first membrane and a plurality of first thermally-conductive supports. The first membrane so provided has an upper surface and a lower surface, and a plurality of pores with upper pore ends at the upper surface of the first membrane and with lower pore ends at the lower surface of the first membrane. Each of the first thermally-conductive supports so provided has upper and lower support ends, wherein the upper support ends of the first thermally-conductive supports are in contact with the first membrane. Step 1215 includes positioning the lower support ends of the first thermally-conductive supports in contact with a thermal energy source to conduct thermal energy from the lower support ends to the first membrane; and providing a liquid working fluid in contact with the lower or upper surface of the first membrane. Step 1220 includes causing the liquid working fluid to be evaporated from a liquid-vapor interface in the first membrane and away from the upper or lower surface of the first membrane. The process may then end at step 1225.

In an example, providing the wick evaporator in step 1210 may further include providing a case having a lower interior surface spaced apart from and facing an upper interior surface of the case, the wick evaporator being in the case and partitioning the case into first and second regions, wherein the first region includes the lower surface of the first membrane, and the lower interior surface of the case, and the first thermally-conductive supports, and wherein the second region includes the upper surface of the first membrane.

Further in that example, step 1220 may include causing the working fluid to be evaporated away from the upper surface of the first membrane and transported from the second region to a condenser, and causing the condensed working fluid to be carried back to the first region. Further in that example, providing the working fluid in step 1220 may include providing a working fluid mixture including a more-volatile fluid and a less-volatile fluid. Additionally in that example, step 1220 may include causing a vapor phase including the less-volatile fluid to be transported from the second region to a condenser, causing less-volatile fluid vapor to be condensed, and causing the condensed less-volatile fluid to be carried through a conduit back to the first region in a continuous heat transfer cycle of evaporation and condensation. Further in that example, step 1220 may include causing a vapor phase including the more-volatile fluid to be transported from the second region to the condenser, causing more-volatile fluid to be condensed, causing more-volatile fluid to be carried at least partially through the conduit together with the condensed less-volatile fluid, causing the more-volatile fluid to be vaporized in the conduit and to propel the less-volatile fluid through the conduit, and to then selectively return the vaporized more-volatile fluid to the second region in a continuous cycle.

Alternatively, step 1220 may include causing the working fluid to be evaporated away from the lower surface of the first membrane and transported from the first region to a condenser, and causing the condensed working fluid to be carried back to the second region. Further in that example, providing the working fluid in step 1220 may include providing a working fluid mixture including a more-volatile fluid and a less-volatile fluid. Additionally in that example, step 1220 may include causing a vapor phase including the less-volatile fluid to be transported from the first region to a condenser, causing less-volatile fluid vapor to be condensed, and causing the condensed less-volatile fluid to be carried through a conduit back to the second region in a continuous heat transfer cycle of evaporation and condensation. Further in that example, step 1220 may include causing a vapor phase including the more-volatile fluid to be transported from the first region to the condenser, causing more-volatile fluid to be condensed, causing more-volatile fluid to be carried at least partially through the conduit together with the condensed less-volatile fluid, causing the more-volatile fluid to be vaporized in the conduit and to propel the less-volatile fluid through the conduit, and to then selectively return the vaporized more-volatile fluid to the first region in a continuous cycle.

The teachings throughout this specification may be utilized in conjunction with the commonly-owned U.S. patent application titled "Directed-Flow Conduit", by Paul Robert Kolodner et al., Ser. No. 12/080409 , filed simultaneously herewith, and the entirety of which is hereby incorporated herein by reference. It is understood that the teachings herein regarding each one of the examples 100, 500, 700, 800, 900, 1000, 1100 of devices are subject to, include, and are deemed to incorporate any and all of the modifications as taught with respect to any other of such examples of devices.

The devices 100, 500, 700, 800, 900, 1000, 1100 may be utilized, for example, in end-use applications where transfer of waste- or excessive-heat may be needed. As examples, the devices 100, 500, 700, 800, 900, 1000, 1100 may be utilized to protect an apparatus that generates thermal energy that may damage or destroy such an apparatus or degrade its performance where that thermal energy is not removed. Such apparatus may include, as examples, a microelectronic device such as a semiconductor chip die, a multi-chip module, a microprocessor, an integrated circuit, or another electronic system. In further examples, the devices 100, 500, 700, 800, 900, 1000, 1100 may be utilized to cool or to protect an apparatus that is exposed to thermal energy from an external source. As examples, thermally-conductive supports of a device 100, 500, 700, 800, 900, 1000, 1100 may be positioned adjacent to apparatus as in these utilization examples such that thermal energy may be removed from the apparatus. In an example, a device 100, 500, 700, 800, 900, 1000, 1100 may be attached to such an apparatus utilizing a heat-spreading material such as diamond or graphite, to increase transfer of thermal energy into the device 100, 500, 700, 800, 900, 1000, 1100. In further examples (not shown), a device 100, 500, 700, 800, 900, 1000, 1100 may include a case that is integral with such an apparatus. Where a device 100, 500, 700, 800, 900, 1000, 1100 includes a case, the case may be suitably positioned with respect to such an apparatus so that thermal energy may be removed from such an apparatus. Although the devices 800, 900, 1000, 1100 have been discussed in connection with condensers 846, 946, 1046, 1146, other condensers located within or outside such cases may be utilized. The process 1200 may be utilized in connection with operating a suitable device having a wick evaporator including a membrane and thermally-conductive supports as discussed herein, of which the devices 100, 500, 700, 800, 900, 1000, 1100 are only examples. Other configurations of devices 100, 500, 700, 800,900, 1000, 1100 may be utilized consistent with the teachings herein. Likewise, the process 1200 may include additional steps and modifications of the indicated steps.

Moreover, it will be understood that the foregoing description of numerous examples has been presented for purposes of illustration and description. This description is not exhaustive and does not limit the claimed invention to the precise forms disclosed. Modifications and variations are possible in light of the above description or may be acquired from practicing the invention. The claims and their equivalents define the scope of the invention.

What is claimed is:

1. A device, comprising:

a first wick evaporator, including:

a first membrane having an upper surface and a lower surface, and a plurality of pores with upper pore ends at the upper surface and with lower pore ends at the lower surface;

a plurality of first thermally-conductive supports, each of the first thermally-conductive supports having an upper support end spaced apart along a longitudinal axis from a lower support end, the upper support ends being in contact with the first membrane;

each of the first thermally-conductive supports having a lateral wall extending along the longitudinal axis between the upper and lower support ends; and a plurality of additional pores, each additional pore forming a passageway through a first thermally-conductive support communicating between the upper support end and the lateral wall;

wherein the first wick evaporator is configured to conduct thermal energy through the first thermally-conductive supports from the lower support ends to the first membrane.

2. The device of claim 1, wherein the first membrane includes a primary membrane in contact with a secondary membrane, wherein the primary membrane includes the upper surface of the first membrane and has a composition including a randomly porous material, and wherein the secondary membrane includes the lower surface of the first membrane and has an array of further pores each extending between the primary membrane and the lower surface of the first membrane.

3. The device of claim 1, further including a case having a lower interior surface spaced apart from and facing an upper interior surface of the case, wherein the case is partitioned by the first membrane into first and second regions, wherein the first region includes the lower surface of the first membrane and the first thermally-conductive supports, and wherein the second region includes the upper surface of the first membrane.

4. The device of claim 3, further including a condenser, wherein the first region is configured for containing a liquid working fluid for evaporation through the first membrane into the second region, and wherein the condenser is configured for receiving vaporized working fluid from the second region and for returning condensed working fluid to the first region.

5. The device of claim 4, wherein the device is configured for returning vaporized working fluid to the second region.

6. The device of claim 3, further including a condenser, wherein the second region is configured for containing a liquid working fluid for evaporation, through the first membrane into the first region, and wherein the condenser is configured for receiving vaporized working fluid from the first region and for returning condensed working fluid to the second region.

7. The device of claim 6, wherein the device is configured for returning vaporized working fluid to the first region.

8. The device of claim 3, including:

a second wick evaporator, including:

a second membrane having an upper surface and a lower surface, and a plurality of pores with upper pore ends at the upper surface and with lower pore ends at the lower surface;

a plurality of second thermally-conductive supports, each of the second thermally-conductive supports having an upper support end spaced apart along a longitudinal axis from a lower support end, the upper support ends being in contact with the second membrane;

each of the second thermally-conductive supports having a lateral wall extending along the longitudinal axis between the upper and lower support ends; and a plurality of additional pores, each additional pore forming a passageway through a second thermally-conductive support communicating between the upper support end and the lateral wall;

wherein the second wick evaporator is configured to conduct thermal energy through the second thermally-conductive supports from the lower support ends to the second membrane.

9. The device of claim 8, wherein a part of the second region is partitioned by the second membrane into a third region, wherein the second region includes the upper surface of the first membrane and the lower surface of the second membrane, and wherein the third region includes the upper surface of the second membrane and the upper interior surface of the case.

10. The device of claim 9, further including a condenser, wherein the first region is configured for containing a liquid working fluid for evaporation through the first membrane into the second region, and wherein the third region is configured for containing a liquid working fluid for evaporation through the second membrane into the second region, and wherein the condenser is configured for receiving vaporized working fluid from the second region and for returning condensed working fluid to the first and third regions.

11. The device of claim 9, further including a condenser, wherein the second region is configured for containing a liquid working fluid for evaporation through the first membrane into the first region and for evaporation through the second membrane into the third region, and wherein the condenser is configured for receiving vaporized working fluid from the first and third regions and for returning condensed working fluid to the second region.

12. A device, comprising:

a first wick evaporator, including:

a first membrane having an upper surface and a lower surface, and a plurality of pores with upper pore ends at the upper surface and with lower pore ends at the lower surface:

plurality of first thermally-conductive supports, each of the first thermally-conductive supports having an upper support end spaced apart along a longitudinal axis from a lower support end, the upper ends being in contact with the first membrane;

each of the first thermally-conductive supports having a first stage that includes the lower support end of the first thermally-conductive support; and each of the first thermally-conductive supports having a second stage that includes the upper support end of the first thermally-conductive support, the second stage including a spaced-apart plurality of intermediate thermally-conductive supports extending along the longitudinal axis from the upper support end to the first stage;

wherein the first wick evaporator is configured conduct thermal energy through the first thermally-conductive support, from the lower support ends through the first stages and then through the second stages to the first membrane.

13. The device of claim 12, wherein the first membrane includes a primary membrane in contact with a secondary membrane, wherein the primary membrane includes the upper surface of the first membrane and has a composition including a randomly porous material, and wherein the secondary membrane includes the lower surface of the first membrane and has an array of further pores each extending between the primary membrane and the lower surface of the first membrane.

14. The device of claim 12, further including a case having a lower interior surface spaced apart from and facing an upper interior surface of the case, wherein the case is partitioned by the first membrane into first and second regions, wherein the first region includes the lower surface of the first membrane and the first thermally-conductive supports, and wherein the second region includes the upper surface of the first membrane.

15. The device of claim 14, further including a condenser, wherein the first region is configured for containing a liquid working fluid for evaporation through the first membrane into the second region, and wherein the condenser is configured for receiving vaporized working fluid from the second region and for returning condensed working fluid to the first region.

16. The device of claim 15, wherein the device is configured for returning vaporized working fluid to the second region.

17. The device of claim 14, further including a condenser, wherein the second region is configured for containing a liquid working fluid for evaporation through the first membrane into the first region, and wherein the condenser is configured for receiving vaporized working fluid from the first region and for returning condensed working fluid to the second region.

18. The device of claim 17, wherein the device is configured for returning vaporized working fluid to the first region.

19. The device of claim 14, including:

a second wick evaporator, including:

a second membrane having an upper surface and a lower surface, and a plurality of pores with upper pore ends at the upper surface and with lower pore ends at the lower surface;

a plurality of second thermally-conductive supports, each of the second thermally-conductive supports having an upper support end spaced apart along a longitudinal axis from a lower support end, the upper support ends being in contact with the second membrane;

each of the second thermally-conductive supports having a first stage that includes the lower support end of the second thermally-conductive support; and each of the second thermally-conductive supports having a second stage that includes the upper support end of the second thermally-conductive support the second stage including a spaced-apart plurality of intermediate thermally-conductive supports extending along longitudinal axis from the upper support end to the first stage;

wherein the second wick evaporator is configured to conduct thermal energy through the second thermally-conductive supports, from the lower support ends through the first stages and then through the second stages to the second membrane.

20. The device of claim 19, wherein a part of the second region is partitioned by the second membrane into a third region, wherein the second region includes the upper surface of the first membrane and the lower surface of the second membrane, and wherein the third region includes the upper surface of the second membrane and the upper interior surface of the case.

21. The device of claim 20, further including a condenser, wherein the first region is configured for containing a liquid working fluid for evaporation through the first membrane into the second region, and wherein the third region is configured for containing a liquid working fluid for evaporation through the second membrane into the second region, and wherein the condenser is configured for receiving vaporized working fluid from the second region and for returning condensed working fluid to the first and third regions.

22. The device of claim 20, further including a condenser, wherein the second region is configured for containing a liquid working fluid for evaporation through the first membrane into the first region and for evaporation through the second membrane into the third region, and wherein the condenser is configured for receiving vaporized working fluid from the first and third regions and for returning condensed working fluid to the second region.

23. A process, comprising:

providing a wick evaporator including a first membrane having an upper surface and a lower surface, and a plurality of pores with upper pore ends at the upper surface of the first membrane and with lower pore ends at the lower surface of the first membrane, the wick evaporator further including a plurality of first thermally-conductive supports each having upper and lower support ends, wherein the upper support ends of the first thermally-conductive supports are in contact with the first membrane;

providing a case having a lower interior surface spaced part from and facing an upper interior surface of the case, the wick evaporator being in the case and partitioning the case into first and regions, the first region including the lower surface of the first membrane and the first thermally-conductive supports and the second region including the upper surface of the first membrane; and either providing a liquid working fluid in contact with the lower surface of the first membrane, causing the liquid working fluid to be evaporated and transported into the second region and then to a condenser, and causing the condensed working fluid to then be carried to the first region; or providing a liquid working fluid in contact with the upper surface of the first membrane, causing the liquid working fluid to be evaporated and transported into the first region and then to a condenser, and causing the condensed working fluid to then be carried to the second region.

24. The process of claim 23, wherein providing the first thermally-conductive supports either includes providing a first thermally-conductive support having a lateral wall extending along a longitudinal axis between the upper and lower support ends, and having an additional pore forming a passageway through the first thermally-conductive support communicating between the upper support end and the lateral wall; or includes providing a first thermally-conductive support having a first stage that includes the lower support end, and having a second stage that includes the upper support end and a spaced-apart plurality of intermediate thermally-conductive supports extending along the longitudinal axis from the upper support end to the first stage.

25. A process, comprising:

providing a wick evaporator including a first membrane having an upper surface and a lower surface, and a plurality of pores with upper pore ends at the upper surface of the first membrane and with lower pore ends at the lower surface of the first membrane, the wick evaporator further including a plurality of first thermally-conductive supports each having upper and lower support ends, wherein the upper support ends of the first thermally-conductive supports are in contact with the first membrane;

providing a case having a lower interior surface spaced apart front and facing an upper interior surface of the case, the wick evaporator being in the case and partitioning the case into first and second regions, the first region including the lower surface of the first membrane and the first thermally-conductive supports, and the second region including the upper surface of the first membrane;

providing a liquid working fluid mixture including a more-volatile fluid and a less-volatile fluid; and either placing the liquid working fluid mixture in contact with the lower surface of the first membrane, causing the liquid working fluid mixture to be evaporated and transported into the second region and then to a condenser causing the more-volatile and less-volatile fluids to then be condensed, and then causing the more-volatile fluid to be evaporated to propel the condensed less-volatile fluid back to the first region; or placing the liquid working fluid mixture in contact with the upper surface of the first membrane, causing the liquid working fluid mixture to be evaporated and transported into the first region and then to a condenser, causing the more-volatile and less-volatile fluids to then be condensed, and then causing the more-volatile fluid to be evaporated to propel the condensed less-volatile fluid back to the second region.

26. The process of claim 25, wherein providing the first thermally-conductive supports either includes providing a first thermally-conductive support having a lateral wall extending along a longitudinal axis between the upper and lower support ends, and having an additional pore forming a passageway through the first thermally-conductive support communicating between the upper support end and the lateral wall; or includes providing a first thermally-conductive support having a first stage that includes the lower support end, and having a second stage that includes the upper support end and a spaced-apart plurality of intermediate thermally-conductive supports extending along the longitudinal axis from the upper support end to the first stage.

* * * * *